US008038246B2

(12) United States Patent
Endo

(10) Patent No.: US 8,038,246 B2
(45) Date of Patent: Oct. 18, 2011

(54) LIQUID EJECTION CONTROL METHOD AND LIQUID EJECTION APPARATUS

(75) Inventor: Hironori Endo, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/347,003

(22) Filed: Dec. 31, 2008

(65) Prior Publication Data

US 2009/0115809 A1 May 7, 2009

Related U.S. Application Data

(63) Continuation of application No. 11/822,175, filed on Jul. 3, 2007, now Pat. No. 7,478,893, which is a continuation of application No. 10/612,394, filed on Jul. 3, 2003, now Pat. No. 7,255,411.

(30) Foreign Application Priority Data

Jul. 5, 2002 (JP) ..... 2002-197598
Sep. 30, 2002 (JP) ..... 2002-286930

(51) Int. Cl.
*B41J 29/38* (2006.01)
*B41J 29/393* (2006.01)

(52) U.S. Cl. ..... 347/14; 347/12; 347/19

(58) Field of Classification Search ..... 347/12, 347/14, 19

See application file for complete search history.

(56) References Cited

U.S. PATENT DOCUMENTS 6,073,928 A 6/2000 Yamaguchi
6,746,101 B2 6/2004 Otsuki
6,964,466 B1 11/2005 Kodama et al.
7,077,499 B2 7/2006 Kodama et al.
7,165,827 B2 1/2007 Otsuki
7,255,434 B2 8/2007 Kodama
7,296,886 B2 11/2007 Kodama et al.
7,431,423 B2 10/2008 Otsuki
7,478,893 B2 * 1/2009 Endo ..... 347/16
7,562,955 B2 7/2009 Otsuki
2002/0070991 A1 6/2002 Otsuki
2002/0070994 A1 * 6/2002 Otsuki et al. ..... 347/19
2002/0089564 A1 * 7/2002 Ohashi ..... 347/41
2006/0066667 A1 3/2006 Kodama et al.
2006/0103711 A1 5/2006 Kodama et al.
2008/0018704 A1 1/2008 Kodama et al.
2009/0033697 A1 2/2009 Otsuki

FOREIGN PATENT DOCUMENTS

JP 2-255360 A 10/1990
JP 8-67040 A 3/1996
JP 09233287 A 9/1997
JP 10-217562 A 8/1998
JP 10-291689 A 11/1998
JP 2000127367 A 5/2000
JP 2000-351205 A 12/2000
JP 2001-096874 A1 4/2001

(Continued)

*Primary Examiner* — Julian Huffman

(57) ABSTRACT

It is an object of the invention to achieve a liquid ejection control method and the like that allows the amount of consumed liquid to be reduced. The liquid ejection control method controls the ejection of liquid, from nozzles for ejecting liquid, onto a medium that is fed in a predetermined feed direction, and has a step of detecting a portion of the medium that is positioned on an upstream side in said feed direction, and a step of not ejecting liquid from nozzles of a plurality of nozzles that are located on the upstream side in the feed direction based on the results of the detection.

6 Claims, 12 Drawing Sheets

FOREIGN PATENT DOCUMENTS

| | | | |
|---|---|---|---|
| JP | 2001-347692 | A | 12/2001 |
| JP | 2002-67444 | A | 3/2002 |
| JP | 2002-103586 | A1 | 4/2002 |
| JP | 2002-103587 | A | 4/2002 |
| JP | 2002-160416 | A1 | 6/2002 |

* cited by examiner

| NUMBER OF TIMES REPEATED [A] | NOZZLES THAT DO NOT EJECT INK[B] | NUMBER OF NOZZLES THAT DO NOT EJECT INK[C] | UPSTREAM SIDE SUPRA-NOZZLES [D] | NUMBER OF UPSTREAM SIDE SUPRA-NOZZLES [E] | VALUE OF E-C [F] |
|---|---|---|---|---|---|
| 1 | #353 ～#360 | 8 | #261～#360 | 100 | 92 |
| 2 | #340 ～#360 | 21 | | | 79 |
| 3 | #328 ～#360 | 33 | | | 67 |
| ⋮ | ⋮ | ⋮ | | | ⋮ |
| 8 | #265 ～#360 | 96 | | | 4 |
| (9) | (#253 ～#360) | (108) | | | (-8) |

FIG. 14

LIQUID EJECTION CONTROL METHOD AND LIQUID EJECTION APPARATUS

CROSS-REFERENCE TO RELATED APPLICATIONS

This is a continuation of application Ser. No. 11/822,175 filed Jul. 3, 2007, which is a continuation of application Ser. No. 10/612,394 filed Jul. 3, 2003. The entire disclosure of the prior applications, application Ser. No. 10/612,394 and application Ser. No. 11/822,175 are hereby incorporated by reference. This application also claims priority upon Japanese Patent Application No. 2002-197598 filed on Jul. 5, 2002, and upon Japanese Patent Application No. 2002-286930 filed on Sep. 30, 2002, which are herein incorporated by reference.

BACKGROUND OF THE INVENTION

1. Field of the Invention

The present invention relates to liquid ejection control methods and liquid ejection apparatuses.

2. Description of the Related Art

Color inkjet printers are already well known as representative liquid ejection apparatuses. These color inkjet printers are provided with a print head, which is an example of an inkjet-type ejection head, for ejecting ink, which is an example of a liquid, from nozzles, and are configured so as to record images and characters, for example, by ejecting ink onto print paper, which is an example of a medium.

The print head is supported on a carriage in a state with the nozzle face in which the nozzles are formed in opposition to the print paper, and moves (performs main scanning) in the width direction of the print paper along a guide member, ejecting ink in synchronization with this main scan.

Moreover, color inkjet printers that allow so-called borderless printing, in which the entire surface of the print paper is targeted for printing, have become popular in recent years because, among other things, they allow an output result of an image that is comparable to a photograph to be obtained. Borderless printing for example allows printing to be carried out by ejecting ink without leaving borders at the four edges of the print paper.

However, when the operation for feeding the print paper and the operation for ejecting ink are carried out repeatedly in order to print the print paper, sooner or later, such as immediately before printing is over, a state in which some of the nozzles of the nozzle face are no longer in opposition to the print paper will occur. In this state, when ink is ejected from nozzles that are not in opposition to the print paper, ink is needlessly wasted.

The condition of ink being ejected from nozzles that are not in opposition to the print paper in the above state is particularly likely to occur in the case of borderless printing, because printing is carried out with respect to the entire surface of the print paper, and this increases the need to solve the above problem.

SUMMARY OF THE INVENTION

The present invention was arrived in light of the foregoing problems, and it is an object thereof to provide a liquid ejection control method and a liquid ejection device that reduce the amount of liquid that is used.

A primary aspect of the present invention is the following liquid ejection control method.

A liquid ejection control method for controlling ejection of liquid, from nozzles for ejecting liquid, onto a medium that is fed in a predetermined feed direction comprises the following steps:

a step of detecting a portion of said medium that is positioned on an upstream side in said feed direction; and a step of not ejecting liquid from nozzles of a plurality of nozzles that are located on the upstream side in said feed direction based on the results of said detection.

Features of the present invention other than the above will become clearer through the accompanying drawings and the following description.

BRIEF DESCRIPTION OF THE DRAWINGS

For a more complete understanding of the present invention and the advantages thereof, reference is now made to the following description taken in conjunction with the accompanying drawings.

FIG. 14 is an explanatory diagram for describing the method for determining the timing at which to end the ink ejection operation.

DETAILED DESCRIPTION OF THE INVENTION

Figure 1:
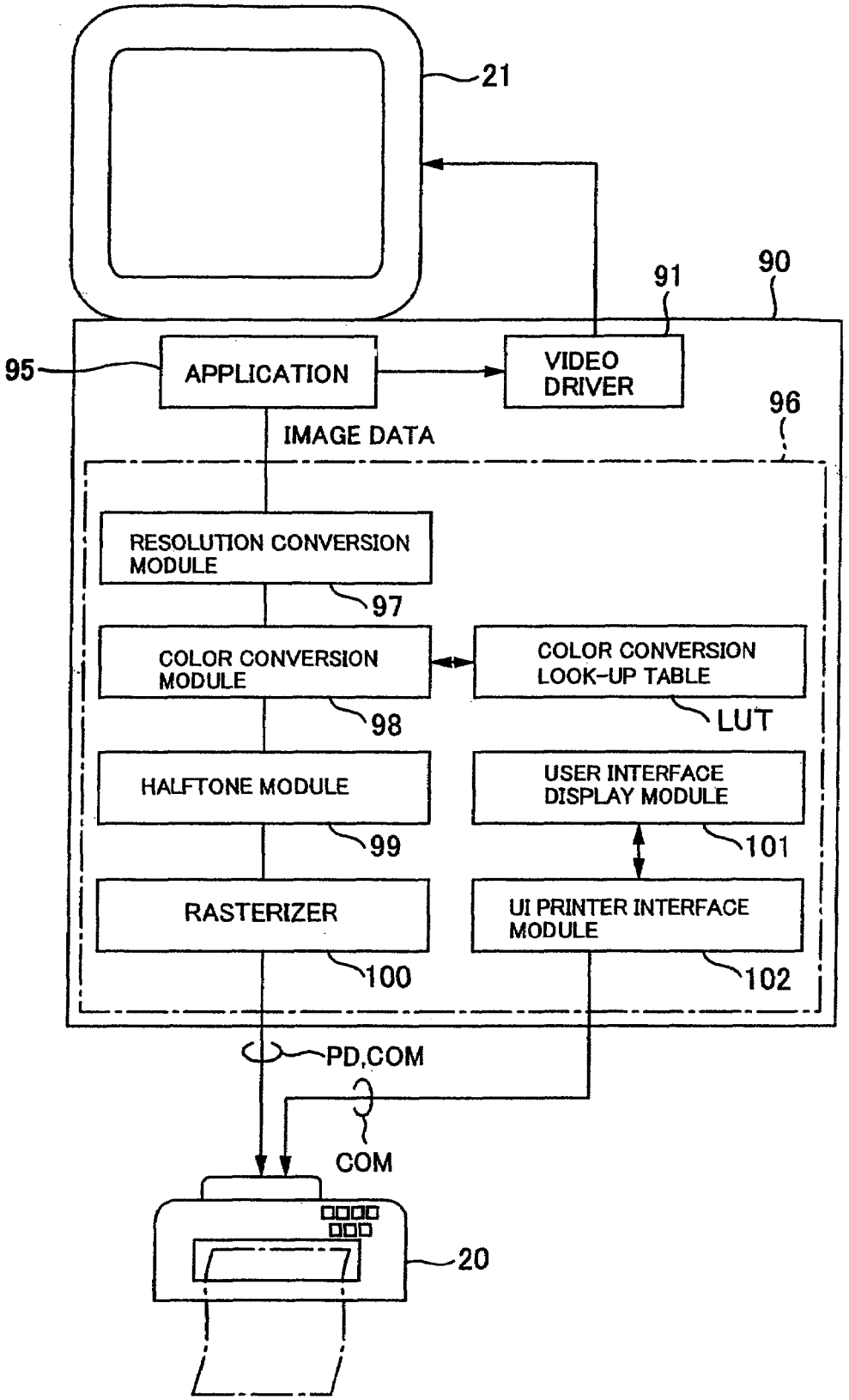
FIG. 1 is a block diagram showing the configuration of a printing system serving as an example of the present invention.

At least the following matters will be made clear by the explanation in the present specification and the description of the accompanying drawings.

A liquid ejection control method for controlling ejection of liquid from nozzles for ejecting liquid onto a medium that is fed in a predetermined feed direction comprises the following steps:

a step of detecting a portion of the medium that is positioned on an upstream side in the feed direction; and a step of making nozzles, among a plurality of nozzles, that are located on the upstream side in the feed direction not eject liquid based on a result of the detection.

With this liquid ejection control method, the amount of liquid that is used can be reduced.

It is preferable that the nozzles that are located on the upstream side in the feed direction are a nozzle located most upstream in the feed direction and nozzles within a predetermined distance in the feed direction from the nozzle.

With this liquid ejection control method, it is possible to further reduce the amount of liquid that is used.

It is further possible that after the portion of the medium that is positioned on the upstream side in the feed direction has been detected, a step of feeding the medium in the feed direction and a step of moving an ejection head provided with the plurality of nozzles and ejecting liquid onto the medium are repeated a predetermined number of times, and then the ejection of liquid onto the medium is ended.

With this liquid ejection control method, the medium can by completely filled with dots.

It is further possible that the predetermined number of times is a plurality of times, and that the predetermined distance is increased in the step of ejecting liquid onto the medium in correspondence with an increase of an aggregate paper feed amount of the medium after the portion of the medium that is positioned on the upstream side in the feed direction has been detected.

With this liquid ejection control method, the number of nozzles that are kept from ejecting liquid can be increased to correspond to an increase in the number of nozzles that are not in opposition to the medium, and thus, the amount of liquid that is used can be further reduced.

It is further preferable that the predetermined distance is an amount obtained by subtracting a predetermined amount from the aggregate paper feed amount.

With this liquid ejection control method, a margin can be secured taking into account the detection error when the portion of the medium that is positioned on the upstream side in the paper feed direction is detected.

It is further preferable that the higher a detection precision for detecting the portion of the medium that is positioned on the upstream side in the feed direction is, the smaller the predetermined amount is.

With this liquid ejection control method, by adjusting the amount of the margin according to the degree of detection precision, the nozzles that are kept from ejecting liquid can be more effectively determined.

It is further preferable that the portion of the medium that is positioned on the upstream side in the feed direction is detected by determining whether or not an end, among ends of the medium, positioned on the upstream side in the feed direction has passed a predetermined position in the feed direction.

With this liquid ejection control method, the portion of the medium that is positioned on the upstream side in the paper feed direction can be more reliably detected.

It is further preferable that whether or not the end, among the ends of the medium, positioned on the upstream side in the feed direction has passed the predetermined position in the feed direction is determined by determining whether or not the medium is present in a direction of travel of light that is emitted from a light emitting member for emitting light toward a medium support section, based on an output value of a light-receiving sensor for receiving the light that has been emitted by the light emitting member.

With this liquid ejection control method, whether or not the end of the medium that is positioned on the upstream side in the paper feed direction has passed a predetermined position in the paper feed direction can be determined more easily.

It is further preferable that the light is emitted from the light emitting member toward a plurality of different positions in a main-scanning direction, each of the plurality of different positions being the predetermined position in the feed direction on the medium support section, and whether or not the medium is present in the direction of travel of the light is determined based on output values of the light-receiving sensor that has received the light having been emitted.

With this liquid ejection control method, the portion of the medium that is positioned on the upstream side in the paper feed direction can be reliably detected even if the medium is slanted, for example.

It is further preferable that while making a moving member that is provided with the light emitting member and the light-receiving sensor and that can be moved in the main-scanning direction move in the main-scanning direction, the light is emitted from the light emitting member toward the plurality of different positions in the main-scanning direction, each of the plurality of different positions being the predetermined position in the feed direction on the medium support section, and whether or not the medium is present in the direction of travel of the light is determined based on the output values of the light-receiving sensor that has received the light having been emitted.

With this liquid ejection control method, it is not necessary to change the direction in which the light is emitted for each position when light is emitted from the light emitting member toward the plurality of different positions in the main-scanning direction.

It is further preferable that the moving member is provided with the ejection head, and that while making the moving member move in the main-scanning direction, the light is emitted from the light emitting member toward the plurality of different positions in the main-scanning direction, each of the plurality of different positions being the predetermined position in the feed direction, and whether or not the medium is present in the direction of travel of the light is determined based on the output values of the light-receiving sensor that has received the light having been emitted, and liquid is ejected onto the medium from the nozzles provided in the ejection head.

With this liquid ejection control method, the moving member and the moving mechanism of the light emitting member and the light-receiving sensor can be provided as a common mechanism.

It is further preferable that liquid is ejected with respect to an entire surface of the medium.

In this case, an even greater advantage is gained through the above methods because in a state where a portion of the nozzle surface is not in opposition to the medium, liquid is more likely to be ejected from nozzles that are not in opposition to the medium.

It is further preferable that the liquid is ink.

With this liquid ejection control method, the amount of ink that is used can be reduced.

It is further preferable that the portion of the medium that is positioned on the upstream side in the feed direction is detected by determining whether or not the portion of the medium on the upstream side in the feed direction has passed a predetermined position in the feed direction, and that the predetermined distance is increased in correspondence with an increase of an aggregate paper feed amount of the medium to increase a number of the nozzles that are made not to eject the liquid, and if the number of the nozzles that are made not to eject the liquid exceeds a number of predetermined nozzles among the plurality of nozzles, then the operation for ejecting liquid onto the medium is ended.

With this liquid ejection control method, the timing at which the liquid ejection operation is ended can be determined easily.

It is further preferable that when it is determined that the portion of the medium on the upstream side in the feed direction has passed a predetermined position in the feed direction, liquid is not ejected from nozzles other than the predetermined nozzles among the plurality of nozzles.

With this liquid ejection control method, the liquid ejection operation can be ended in a state where there are no longer any nozzles ejecting liquid.

It is further preferable that the predetermined nozzles are in opposition to a recessed section of a medium support section that is provided with the recessed section and that is for supporting the medium.

With this liquid ejection control method, the medium support section does not become dirty, and thus there is the advantage that the rear surface of a medium that is later carried can be kept from becoming dirty, for example.

It is further preferable that the predetermined distance is an amount that is obtained by subtracting a predetermined amount from the aggregate paper feed amount.

With this liquid ejection control method, a margin can be secured taking into account the detection error when the portion of the medium that is positioned on the upstream side in the paper feed direction is detected.

It is further preferable that the higher a detection precision for detecting the position, in the feed direction, of the portion on the upstream side in the feed direction is, the smaller the predetermined amount is.

With this liquid ejection control method, by adjusting the amount of the margin according to the degree of detection precision, the nozzles that are kept from ejecting liquid can be more effectively determined.

A liquid ejection apparatus for ejecting liquid onto a medium comprises:

a plurality of nozzles for ejecting the liquid;

a movable ejection head provided with the plurality of nozzles; and a feed mechanism for feeding the medium in a predetermined feed direction;

wherein a portion of the medium that is positioned on an upstream side in the feed direction is detected, and based on a result of this detection, nozzles, among the plurality of nozzles, that are positioned on the upstream side in the feed direction are made not to eject liquid therefrom.

With this liquid ejection apparatus, the amount of liquid that is used can be reduced.

===Example of the Overall Configuration of the Apparatus===

FIG. 1 is a block diagram showing the configuration of a printing system serving as an example of the present invention. The printing system is provided with a computer 90 and a color inkjet printer 20, which is an example of a liquid ejection apparatus. It should be noted that the printing system including the color inkjet printer 20 and the computer 90 can also be broadly referred to as a "liquid ejection apparatus." Although not shown in the diagram, a computer system is made of the computer 90, the color inkjet printer 20, a display device such as a CRT 21 or a liquid crystal display device, input devices such as a keyboard and a mouse, and a drive device such as a flexible drive device or a CD-ROM drive device.

In the computer 90, an application program 95 is executed under a predetermined operating system. The operating system includes a video driver 91 and a printer driver 96, and the application program 95 outputs print data PD for transfer to the color inkjet printer 20 through these drivers. The application program 95, which carries out retouching of images, for example, carries out a desired process with respect to an image to be processed, and also displays the image on the CRT 21 via the video driver 91.

When the application program 95 issues a print command, the printer driver 96 of the computer 90 receives image data from the application program 95 and converts these into print data PD to be supplied to the color inkjet printer 20. The printer driver 96 is internally provided with a resolution conversion module 97, a color conversion module 98, a halftone module 99, a rasterizer 100, a user interface display module 101, a UI printer interface module 102, and a color conversion look-up table LUT.

The resolution conversion module 97 performs the function of converting the resolution of the color image data formed by the application program 95 to a print resolution. The image data whose resolution is thus converted is image information still made of the three color components RGB. The color conversion module 98 refers to the color conversion look-up table LUT and, for each pixel, converts the RGB image data into multi-gradation data of a plurality of ink colors that can be used by the color inkjet printer 20.

The multi-gradation data that have been color converted have a gradation value of 256 grades, for example. The halftone module 99 executes so-called halftone processing to create halftone image data. The halftone image data are arranged by the rasterizer 100 into the order in which they are to be transferred to the color inkjet printer 20, and are output as the final print data PD. The print data PD include raster data indicating the state in which dots are formed during main scanning, and data indicating the sub-scanning feed amount.

The user interface display module 101 has a function for displaying various types of user interface windows related to printing and a function for receiving input from the user in these windows.

The UI printer interface module 102 functions as an interface between the user interface (UI) and the color inkjet printer. It interprets instructions given by users through the user interface and sends various commands COM to the color inkjet printer. Conversely, it also interprets commands COM received from the color inkjet printer and executes various displays with respect to the user interface.

It should be noted that the printer driver 96 realizes, for example, a function for sending and receiving various types of commands COM and a function for supplying print data PD to the color inkjet printer 20. A program for realizing the functions of the printer driver 96 is supplied in a format in which it is stored on a computer-readable storage medium. Examples of this storage medium include various types of computer-readable media, such as flexible disks, CD-ROMs, magneto optical disks, IC cards, ROM cartridges, punch cards, printed materials on which a code is printed such as a bar code, internal storage devices (memory such as a RAM or a ROM) and external storage devices of the computer. The computer program can also be downloaded onto the computer 90 via the Internet.

Figure 2:
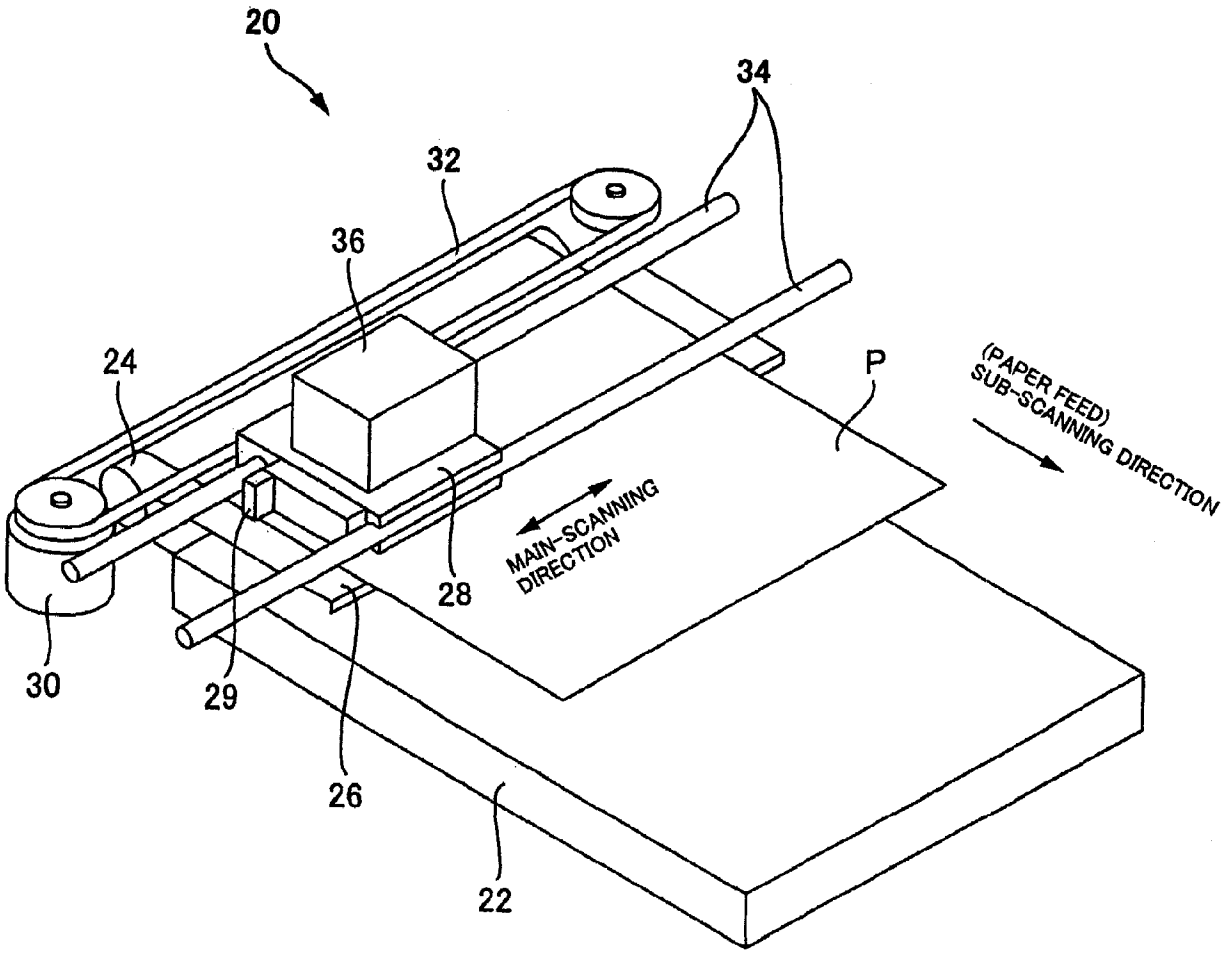
FIG. 2 is a schematic perspective view showing an example of the primary structures of the color inkjet printer 20.

FIG. 2 is a schematic perspective view showing an example of the primary structures of the color inkjet printer 20. The color inkjet printer 20 is provided with a paper stacker 22, a paper feed roller 24 driven by a step motor that is not shown, a platen 26, which is an example of a medium support section for supporting the medium, a carriage 28 serving as an example of a moving member, a carriage motor 30, a pull belt 32 that is driven by the carriage motor 30, and guide rails 34 for the carriage 28. A print head 36, which is an example of an ejection head provided with numerous nozzles, and a reflective optical sensor 29 that will be described in detail later are mounted onto the carriage 28.

The print paper P is rolled from the paper stacker 22 by the paper feed roller 24 and fed in a paper feed direction (hereinafter also referred to as the sub-scanning direction), which is an example of the predetermined feed direction, over the surface of the platen 26. The carriage 28 is pulled by the pull belt 32, which is driven by the carriage motor 30, and moves in the main-scanning direction along the guide rails 34. It should be noted that as shown in the diagram, the main scanning direction refers to the two directions perpendicular to the sub-scanning direction. The paper feed roller 24 is also used to carry out the paper-feed operation for supplying the print paper P to the color inkjet printer 20 and the paper discharge operation for discharging the print paper P from the color inkjet printer 20.

===Example of Configuration of the Reflective Optical Sensor===

Figure 3:
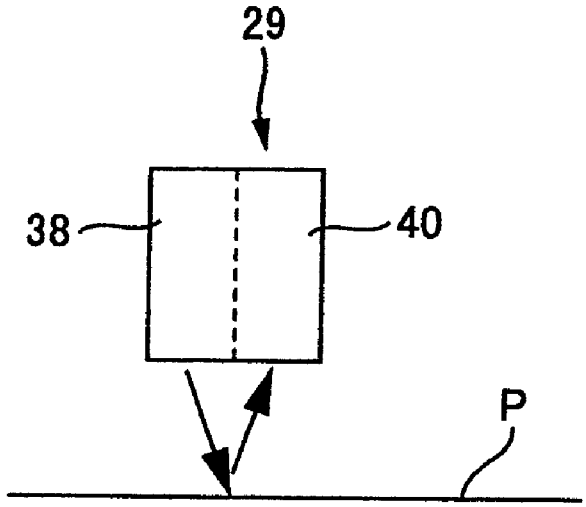
FIG. 3 is a schematic diagram for describing an example of the reflective optical sensor 29.

FIG. 3 is a schematic diagram for describing an example of the reflective optical sensor 29. The reflective optical sensor 29 is attached to the carriage 28, and has a light emitting section 38, which is for example made of a light emitting diode and is an example of a light-emitting member, and a light-receiving section 40, which is for example made of a phototransistor and is an example of a light-receiving sensor. The light that is emitted from the light emitting section 38, that is, the incident light, is reflected by print paper P or by the platen 26 if there is no print paper P in the direction in which the emitted light travels. The light that is reflected is received by the light-receiving section 40 and is converted into an electrical signal. Then, the magnitude of the electrical signal is measured as the output value of the light-receiving sensor corresponding to the intensity of the reflected light that is received.

It should be noted that in the above description, as shown in the figure, the light emitting section 38 and the light-receiving section 40 are provided as a single unit and together constitute the reflective optical sensor 29. However, they may also constitute separate devices, such as a light emitting device and a light-receiving device.

Also, in the above description, the reflected light was converted into an electrical signal and then the magnitude of that electrical signal was measured in order to obtain the intensity of the reflected light that is received. However, this is not a limitation, and it is only necessary that the output value of the light-receiving sensor corresponding to the intensity of the reflected light that is received can be measured.

===Example of Configuration of the Carriage Area===

Figure 4:
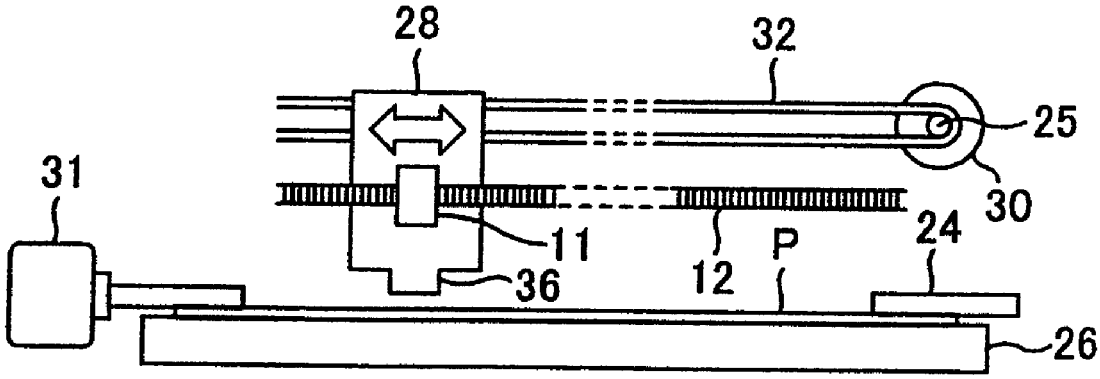
FIG. 4 is a diagram showing the configuration of the carriage 28 area of the inkjet printer.

The configuration of the carriage area is described next. FIG. 4 is a diagram showing the configuration of the carriage 28 area of the inkjet printer.

The inkjet printer shown in FIG. 4 is provided with a paper feed motor (hereinafter referred to as "PF motor") 31, which is as an example of the feed mechanism for feeding paper, the carriage 28 to which the print head 36 for ejecting ink, which is an example of a liquid, onto the print paper P is fastened and which is driven in the main-scanning direction, the carriage motor (hereinafter referred to as "CR motor") 30 for driving the carriage 28, a linear encoder 11 that is fastened to the carriage 28, a code plate 12 for the linear encoder in which slits are formed at a predetermined spacing, a rotary encoder 13, which is not shown, for the PF motor 31, the platen 26 for supporting the print paper P, the paper feed roller 24 driven by the PF motor 31 for carrying the print paper P, a pulley 25 attached to the rotational shaft of the CR motor 30, and the pull belt 32 driven by the pulley 25.

Figure 5:
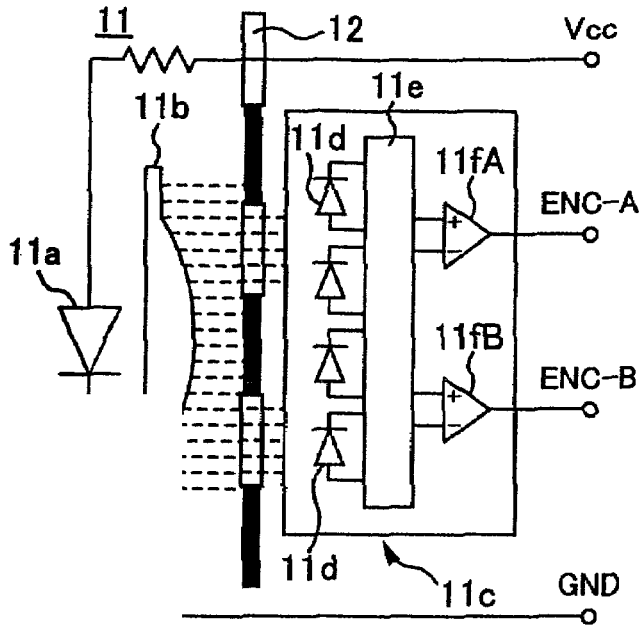
FIG. 5 is an explanatory diagram that schematically shows the configuration of the linear encoder 11 attached to the carriage 28.

Next, the above-described linear encoder 11 and the rotary encoder 13 are described. FIG. 5 is an explanatory diagram that schematically shows the configuration of the linear encoder 11 attached to the carriage 28.

The linear encoder 11 shown in FIG. 5 is provided with a light emitting diode 11*a*, a collimating lens 11*b*, and a detection processing section 11*c*. The detection processing section 11*c* has a plurality of (for example, four) photodiodes 11*d*, a signal processing circuit 11*e*, and for example two comparators 11*f*A and 11*f*B.

The light-emitting diode 11*a* emits light when a voltage Vcc is applied to it via resistors on both sides. This light is condensed into parallel light by the collimating lens 11*b* and passes through the code plate 12 of the linear encoder. The code plate 12 of the linear encoder is provided with slits at a predetermined spacing (for example, 1/180 inch (one inch=2.54 cm)).

The parallel light that passes through the code plate 12 of the linear encoder then passes through stationary slits (not shown) and is incident on the photodiodes 11*d*, where it is converted into electrical signals. The electrical signals that are output from the four photodiodes 11*d* are subjected to signal processing by the signal processing circuit 11*e*, the signals that are output from the signal processing circuit 11*e* are compared in the comparators 11*f*A and 11*f*B, and the results of these comparisons are output as pulses. Then, the pulse ENC-A and the pulse ENC-B that are output from the comparators 11*f*A and 11*f*B become the output of the linear encoder 11.

Figure 6A:
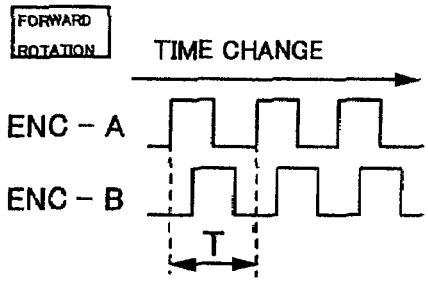
FIG. 6A is a timing chart showing the waveforms of the two output signals of the linear encoder 11 when the CR motor is rotating forward.
Figure 6B:
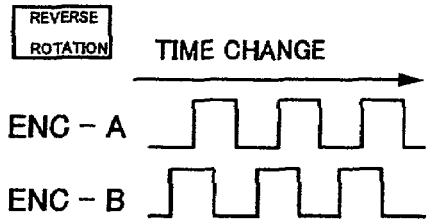
FIG. 6B is a timing chart showing the waveforms of the two output signals of the linear encoder 11 when the CR motor is rotating in reverse.

FIG. 6A is a timing chart showing the waveforms of the two output signals of the linear encoder 11 when the CR motor is rotating forward. FIG. 6B is a timing chart showing the waveforms of the two output signals of the linear encoder 11 when the CR motor is rotating in reverse.

As shown in FIG. 6A and FIG. 6B, the phases of the pulse ENC-A and the pulse ENC-B are misaligned by 90 degrees both when the CR motor is rotating forward and when it is rotating in reverse. When the CR motor 30 is rotating forward, that is, when the carriage 28 is moving in the main-scanning direction, then, as shown in FIG. 6A, the phase of the pulse ENC-A leads the phase of the pulse ENC-B by 90 degrees. On the other hand, when the CR motor 30 is rotating in reverse, then, as shown in FIG. 6B, the phase of the pulse ENC-A is delayed by 90 degrees with respect to the phase of the pulse ENC-B. A single period T of the pulse ENC-A and the pulse ENC-B is equivalent to the time during which the carriage 28 is moved by the slit spacing of the code plate 12 of the linear encoder.

Then, the rising edge and the rising edge of the output pulses ENC-A and ENC-B of the linear encoder 11 are detected, and the number of detected edges is counted. The rotational position of the CR motor 30 is detected based on the number that is calculated. With respect to the calculation, when the CR motor 30 is rotating forward a "+1" is added for each detected edge, and when the CR motor 30 is rotating in reverse a "−1" is added for each detected edge. The period of the pulses ENC-A and ENC-B is equal to the time from when one slit of the code plate 12 of the linear encoder passes through the linear encoder 11 to when the next slit passes through the linear encoder 11, and the phases of the pulse ENC-A and the pulse ENC-B are misaligned by 90 degrees. Accordingly, a count number of "1" of the calculation corresponds to ¼ of the slit spacing of the code plate 12 of the linear encoder. Therefore, if the counted number is multiplied by ¼ of the slit spacing, then the amount that the CR motor 30 has moved from the rotational position corresponding to the count number "0" can be obtained based on this product. The resolution of the linear encoder 11 at this time is ¼ the slit spacing of the code plate 12 of the linear encoder.

On the other hand, the rotary encoder 13 for the PF motor 31 has the same configuration as the linear encoder 11, except that the rotary encoder code plate is a rotation disk that rotates in conjunction with rotation of the PF motor 31. The rotary encoder 13 outputs two output pulses ENC-A and ENC-B, and based on this output the amount of movement of the PF motor 31 can be obtained.

===Example of the Electrical Configuration of the Color Inkjet Printer===

Figure 7:
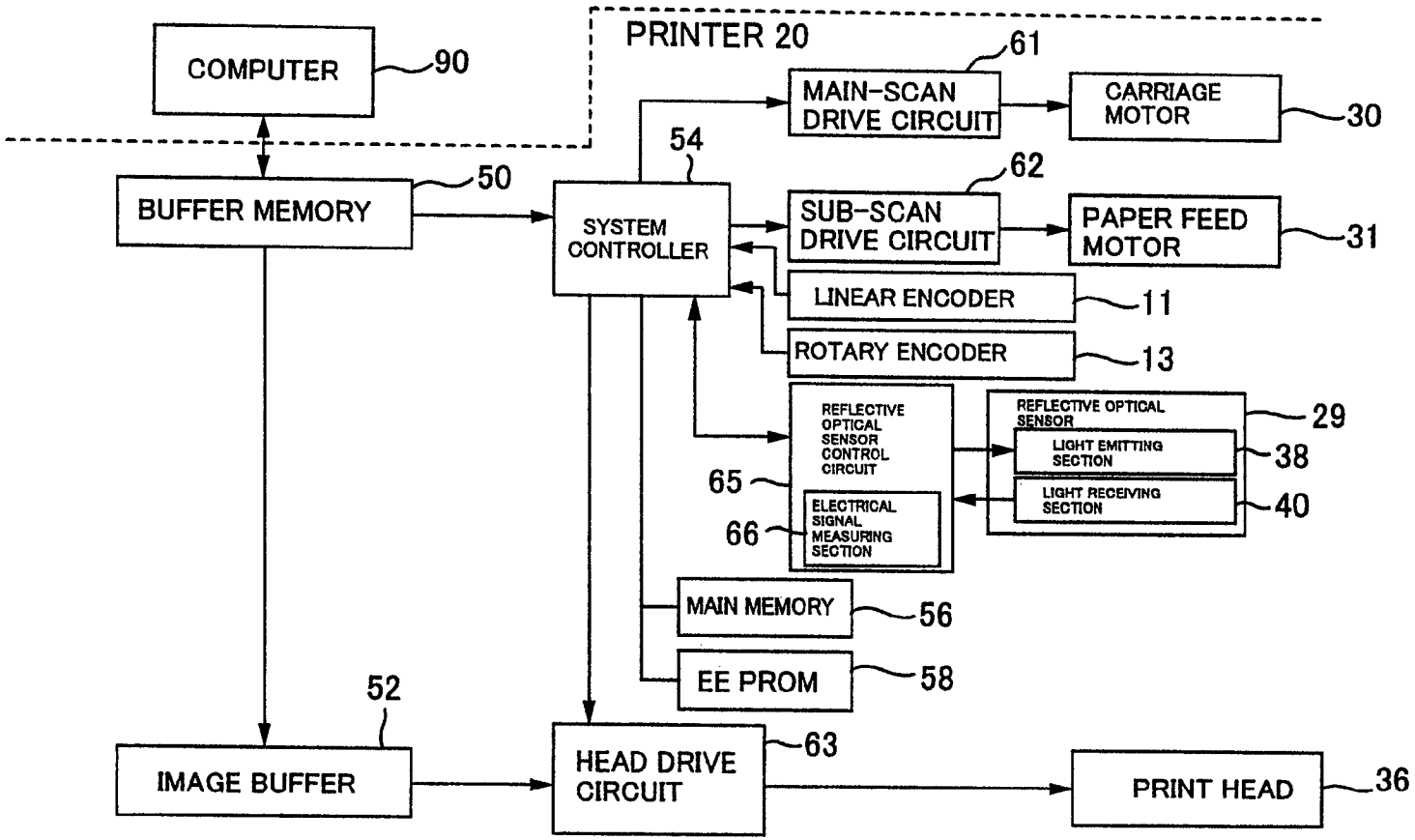
FIG. 7 is a block diagram showing an example of the electrical configuration of the color inkjet printer 20.

FIG. 7 is a block diagram showing an example of the electrical configuration of the color inkjet printer 20. The color inkjet printer 20 is provided with a buffer memory 50 for receiving signals supplied from the computer 90, an image buffer 52 for storing print data, a system controller 54 for controlling the overall operation of the color inkjet printer 20, a main memory 56, and an EEPROM 58. The system controller 54 is connected to a main-scan drive circuit 61 for driving the carriage motor 30, a sub-scan drive circuit 62 for driving the paper feed motor 31, a head drive circuit 63 for driving the print head 36, a reflective optical sensor control circuit 65 for controlling the light emitting section 38 and the light-receiving section 40 of the reflective optical sensor 29, the above-described linear encoder 11, and the above-described rotary encoder 13. Also, the reflective optical sensor control circuit 65 is provided with an electrical signal measuring section 66 for measuring the electrical signals that are converted from the reflected light received by the light-receiving section 40.

The print data that are transferred from the computer 90 are held temporarily in the buffer memory 50. Within the color inkjet printer 20, the system controller 54 reads necessary information from the print data in the buffer memory 50, and based on this information, sends control signals to the main-scan drive circuit 61, the sub-scan drive circuit 62, and the head drive circuit 63, for example.

The image buffer 52 stores print data for a plurality of color components that are received by the buffer memory 50. The head drive circuit 63 reads the print data of the various color components from the image buffer 52 in accordance with the control signals from the system controller 54, and drives the various color nozzle arrays provided in the print head 36 in correspondence with the print data.

===Example of Nozzle Arrangement of Print Head, Etc.===

Figure 8:
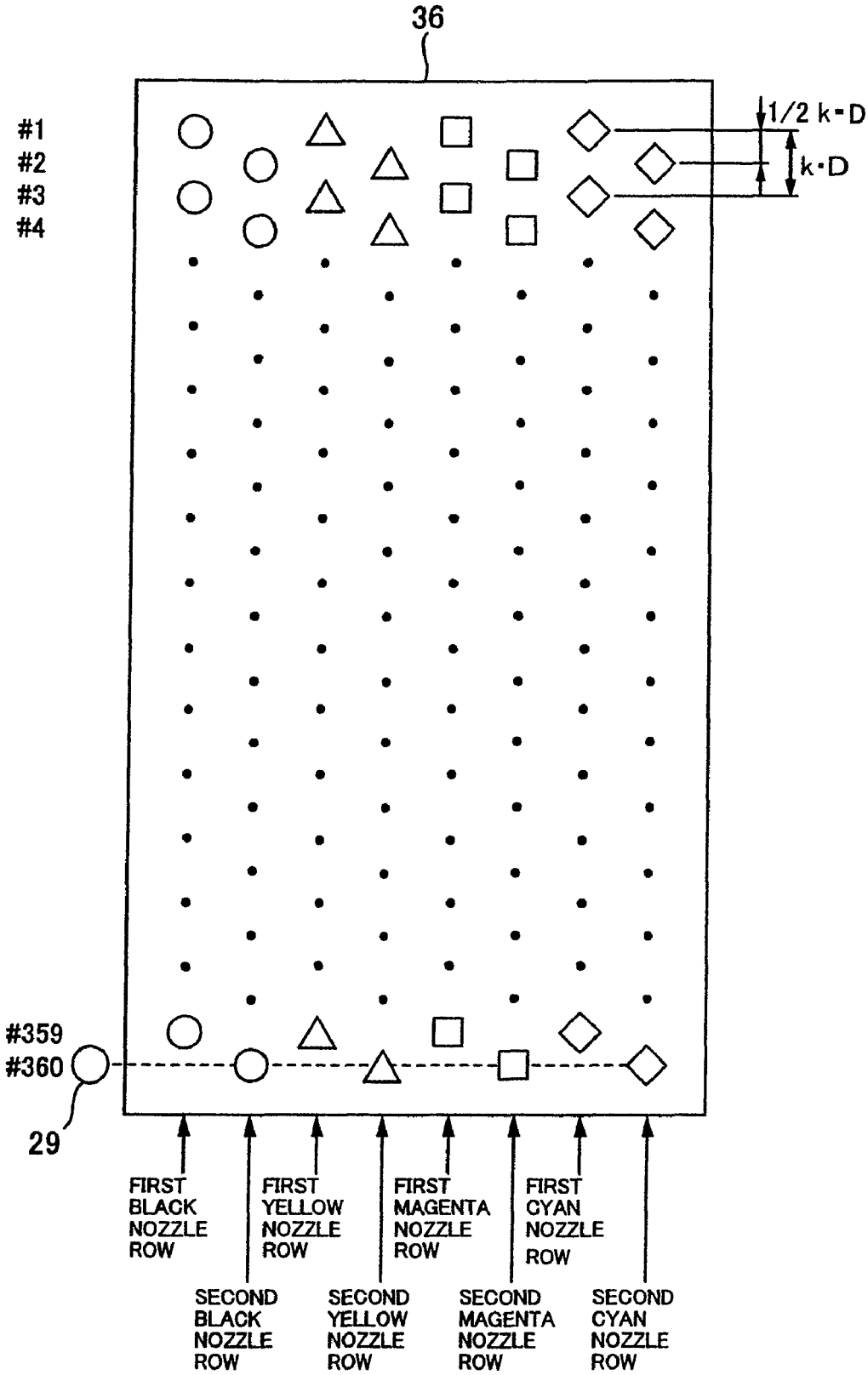
FIG. 8 is an explanatory diagram showing the nozzle arrangement on the bottom surface of the print head 36.

FIG. 8 is an explanatory diagram showing the nozzle arrangement on the bottom surface of the print head 36. The print head 36 has a black nozzle row, a yellow nozzle row, a magenta nozzle row, and a cyan nozzle row, arranged in straight lines in the sub-scanning direction. As shown in the diagram, each of these nozzle rows is constituted by two rows, and in this specification, these nozzle rows are referred to as the first black nozzle row, the second black nozzle row, the first yellow nozzle row, the second yellow nozzle row, the first magenta nozzle row, the second magenta nozzle row, the first cyan nozzle row, and the second cyan nozzle row.

The black nozzle rows (shown by circles) have 360 nozzles, nozzles #1 to #360. Of these nozzles, the odd-numbered nozzles #1, #3, . . . , #359 belong to the first black nozzle row and the even-numbered nozzles #2, #4, . . . , #360 belong to the second black nozzle row. The nozzles #1, #3, . . . , #359 of the first black nozzle row are arranged at a constant nozzle pitch k·D in the sub-scanning direction. Here, D is the dot pitch in the sub-scanning direction, and k is an integer. The dot pitch D in the sub-scanning direction is equal to the pitch of the main scan lines (raster lines). Hereafter, the integer k indicating the nozzle pitch k·D is referred to simply as the "nozzle pitch k." In the example of FIG. 8, the nozzle pitch k is four dots. The nozzle pitch k, however, may be set to any integer.

The nozzles #2, #4, . . . , #360 of the second black nozzle row are also arranged at the constant nozzle pitch k·D (nozzle pitch k=4) in the sub-scanning direction, and as shown in the diagram, the positions of the nozzles in the sub-scanning direction are misaligned with the positions of the nozzles of the first black nozzle row in the sub-scanning direction. In the example of FIG. 8, the amount of this misalignment is ½·k·D (k=4).

The above-described matters also apply for the yellow nozzle rows (shown by white triangles), the magenta nozzle rows (shown by white squares), and the cyan nozzle rows (shown by white diamonds). In other words, each of the these nozzle rows has 360 nozzles #1 to #360, and of the these nozzles, the odd-numbered nozzles #1, #3, . . . , #359 belong to the first nozzle row and the even-numbered nozzles #2, #4, . . . , #360 belong to the second nozzle row. Also, each of these nozzle rows is arranged at a constant nozzle pitch k·D in the sub-scanning direction, and the positions of the nozzles of the second rows in the sub-scanning direction are misaligned with the positions of the nozzles of the first rows in the sub-scanning direction by ½·k·D (k=4).

In other words, the nozzle groups arranged in the print head 36 are staggered, and during printing, ink droplets are ejected from each of the nozzles while the print head 36 is moved in the main-scanning direction at a constant velocity together with the carriage 28. However, depending on the print mode, all of the nozzles are not necessarily always being used, and there are instances in which only some of the nozzles are used.

It should be noted that the above-described reflective optical sensor 29 is provided in the carriage 28 together with the print head 36, and in this embodiment, as shown in the diagram, the position of the reflective optical sensor 29 in the sub-scanning direction matches the position of the above-described nozzles #360 in the sub-scanning direction.

<<<Positional Relationship Between the Nozzle Rows of the Print Head and the Grooves Provided in the Platen>>>

Figure 9:
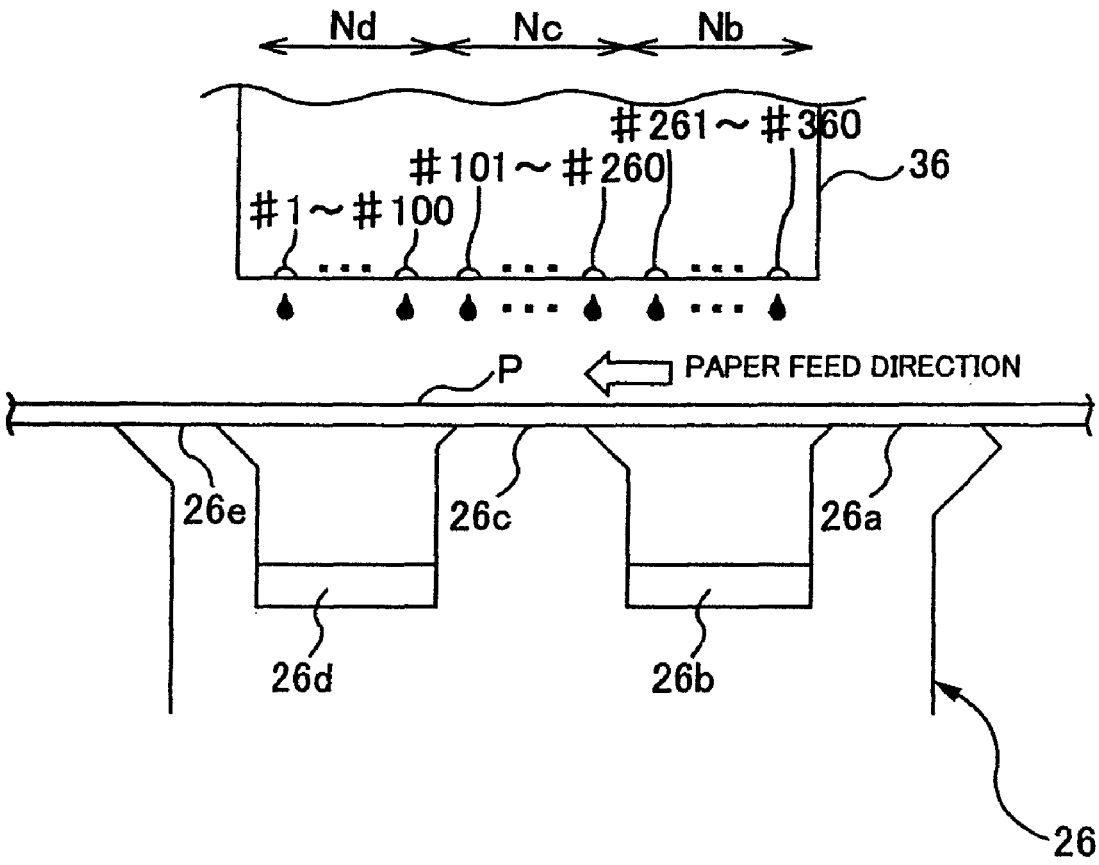
FIG. 9 is an explanatory diagram showing the positional relationship between the nozzle rows of the print head 36 and the grooves provided in the platen 26.

Next, FIG. 9 is used to describe the positional relationship between the above-described nozzle rows of print head 36 and the grooves provided in the platen 26. FIG. 9 is an explanatory diagram showing the positional relationship between the nozzle rows of the print head 36 and the grooves provided in the platen 26.

The platen 26 has recessed sections and protruding sections. For the recessed sections, the platen 26 has two grooves formed in the main-scanning direction. Of these two grooves, the groove on the upstream side is referred to as the upstream side groove 26*b* and the groove on the downstream side is referred to as the downstream side groove 26*d*. These grooves are formed in the platen 26 such that in the main-scanning direction they are longer than the width of the print paper P. These grooves are also provided with an absorptive body for absorbing ink.

Also, as the protruding sections, the platen 26 has an upstream side support section 26*a*, a central support section 26*c*, and a downstream side support section 26*e*. These support sections support the print paper P in such a manner that it is in opposition to the print head 36. The upstream side support section 26*a* supports the print paper P upstream of the upstream side groove 26*b*, the central support section 26*c* supports the print paper P between the upstream side groove 26*b* and the downstream side groove 26*d*, and the downstream side support section 26*e* supports the print paper P downstream of the downstream side groove 26*d*.

The nozzle groups described above and arranged in the print head 36 can each be divided into an upstream side supra-nozzle group Nb, a central nozzle group Nc, and a downstream side supra-nozzle group Nd. The upstream side supra-nozzle group Nb is a nozzle group provided in a position that is in opposition to the upstream side groove 26*b*, and in this configuration, the nozzles #261 to #360 make up this nozzle group. The central nozzle group Nc is a nozzle group provided in a position that is in opposition to the central support section 26*c*, and in this configuration, the nozzles #101 to #260 make up this nozzle group. The downstream side supra-nozzle group Nd is a nozzle group provided in a position that is in opposition to the downstream side groove 26*d*, and in this configuration, the nozzles #1 to #100 make up this nozzle group.

By the carriage 28 moving in the main-scanning direction, the print head 36 is also moved in the main-scanning direction. Since the upstream side groove 26*b* and the downstream side groove 26*d* are formed in the main-scanning direction, it is possible for the upstream side supra-nozzle group Nb to remain in opposition to the upstream side groove 26*b* while moving and for the downstream side supra-nozzle group Nd to remain in opposition to the downstream side groove 26*d* while moving. Even if ink were ejected from the upstream side supra-nozzle group Nb without there being a print paper P on the platen 26, the ink that is ejected would land in the upstream side groove 26*b*, and thus the support sections of the platen 26 would not become dirty, so that later the rear surface of the paper that is carried would not become dirty. Likewise, even if ink were ejected from the downstream side supra-nozzle group Nd without there being a print paper P on the platen 26, the ink that is ejected would land in the downstream side groove 26*d*, and thus the support sections of the platen 26 would not become dirty, so that later the rear surface of the paper that is carried would not become dirty. Moreover, since an ink absorptive body is provided in each of the grooves, the ink that lands in the grooves is absorbed by the ink absorptive bodies, and thus the rear surface of the paper is kept from becoming dirty due to splattering of the ink.

As will be described later, since it is possible for there not be print paper P between the nozzles for ejecting ink that are provided in the print head 30 and the platen 26 when the upstream side portion, in the paper feed direction, of the print paper P is in opposition to the print head 36, the nozzles that eject ink are limited to the upstream side supra-nozzle group Nb, from among the upstream side supra-nozzle group Nb, the central nozzle group Nc, and the downstream side supra-nozzle group Nd, so that the support sections of the platen 26 do not become dirty.

Similarly, the nozzles that eject ink when the downstream side section, in the paper feed direction, of the print paper P is in opposition to the print head 36 are limited to those of the downstream side supra-nozzle group Nd.

First Embodiment

Figure 10:
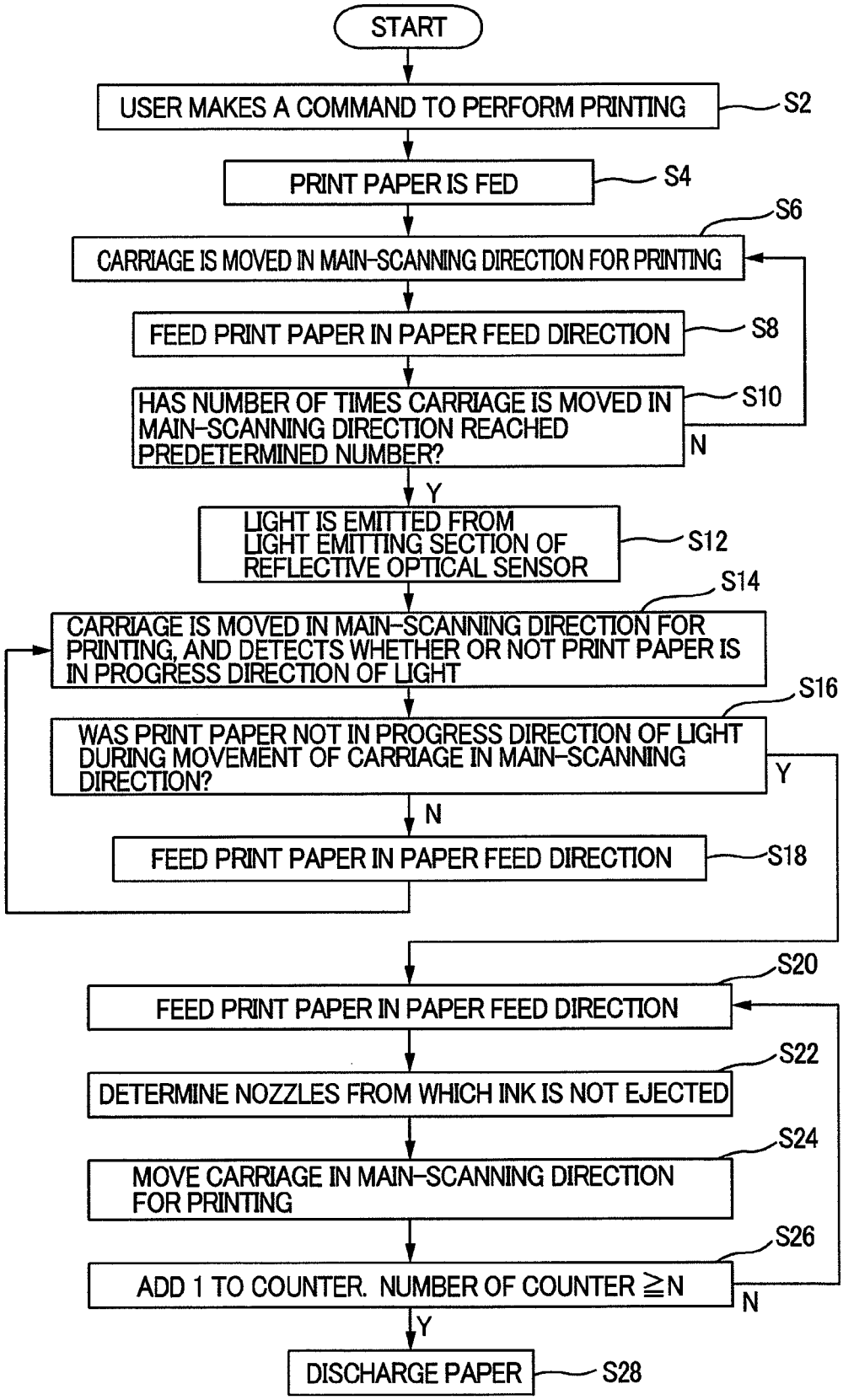
FIG. 10 is a flowchart for describing the first embodiment.
Figures 11A, 11B, 11C:
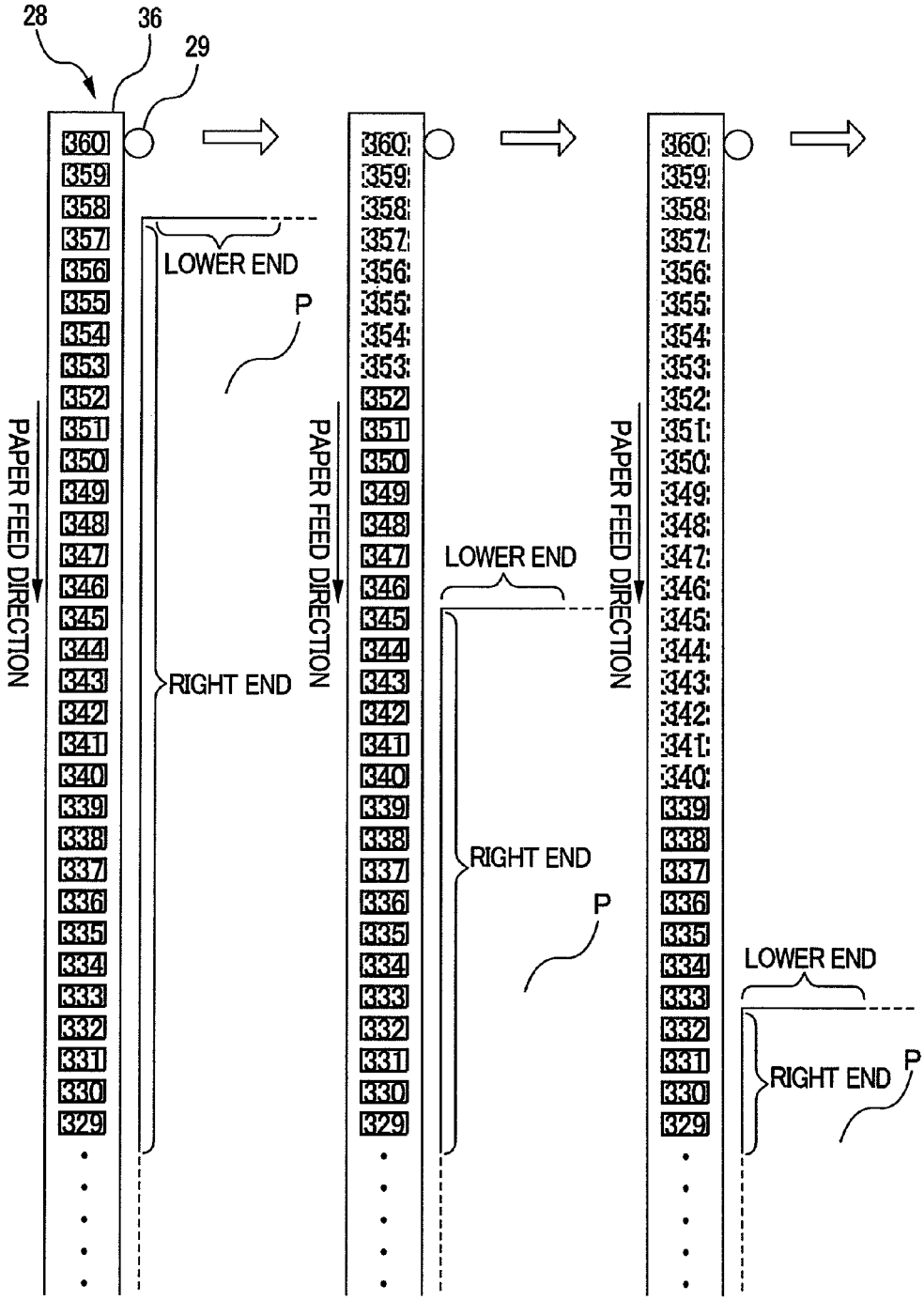
FIG. 11A is diagram that schematically represents the positional relationship between the nozzles of the print head 36 and the print paper P.
FIG. 11B is diagram that schematically represents the positional relationship between the nozzles of the print head 36 and the print paper P.
FIG. 11C is diagram that schematically represents the positional relationship between the nozzles of the print head 36 and the print paper P.

Next, a first embodiment of the present invention is described using FIG. 10, FIG. 11A, FIG. 11B, and FIG. 11C. FIG. 10 is a flowchart for describing the first embodiment. FIG. 11A, FIG. 11B, and FIG. 11C will be described later.

First, the user makes a command to perform printing through the application program 95 or the like (step S2). The application program 95 receives this instruction and issues a print command, at which time the printer driver 96 of the computer 90 receives image data from the application program 95 and converts them to print data PD including raster data indicating the state in which dots are formed during main scanning and data indicating the sub-scanning feed amount. Moreover, the printer driver 96 supplies the print data PD to the color inkjet printer 20 together with various commands COM. The color inkjet printer 20 receives these at its buffer memory 50, after which it sends them to the image buffer 52 or the system controller 54.

The user can also designate the size of the print paper P or issue a command to perform borderless printing to the user interface display module 101. This instruction by the user is received by the user interface display module 101 and sent to the UI printer interface module 102. The UI printer interface module 102 interprets the instruction that has been given, and sends a command COM to the color inkjet printer 20. The color inkjet printer 20 receives the command COM at the buffer memory 50 and then transmits it to the system controller 54.

The color inkjet printer 20 then drives, for example, the paper feed motor 31 by the sub-scanning feed drive circuit 62 based on the command that is sent to the system controller 54 so as to feed the print paper P (step S4).

Then, the system controller 54 moves the carriage 28 in the main-scanning direction as it feeds the print paper P in the paper feed direction, and ejects ink from the print head 36 provided in the carriage 28, thereby carrying out borderless printing (step S6, step S8). It should be noted that the print paper P is fed in the paper feed direction by driving the paper feed motor 31 with the sub-scanning feed drive circuit 62, the carriage 28 is moved in the main-scanning direction by driving the carriage motor 30 with the main scan drive circuit 61, and ink is ejected from the print head 36 by driving the print head 36 with the head drive circuit 63.

The color inkjet printer 20 carries out the operations of step S6 and step S8 in sequence, and if the number of times the carriage 28 is moved in the main-scanning direction reaches a predetermined number of times (step S10), for example, then, after the carriage 28 is next moved in the main-scanning direction, the following operation is performed.

The system controller 54 controls the reflective optical sensor 29, which is provided in the carriage 28, by the reflective optical sensor control circuit 65, so that light is emitted toward the platen 26 from the light emitting section 38 of the reflective optical sensor 29 (step S12).

The system controller 54 drives the carriage 28 in the main-scanning direction and ejects ink from the print head 36 provided in the carriage 28 so as to perform borderless printing, as well as emits light from the light emitting section 38 toward a predetermined position on the platen 26 in the paper feed direction but in a plurality of different positions on the platen 26 in the main-scanning direction, and based on the output values of the light-receiving section 40, which receives the light that is output, detects whether or not the print paper P is in the progress direction of the light (step S14).

It should be noted that as described above, in this embodiment, the position of the reflective optical sensor 29 in the paper feed direction matches the position of the nozzle #360 in the paper feed direction, and thus the predetermined position in the paper feed direction corresponds to the position of the nozzle #360 in the paper feed direction.

Also, in this embodiment, whether or not the print paper P is in the progress direction of the light is always detected while the carriage 28 is moving in the main-scanning direction. That is, when the end of the print paper P blocks the light that is emitted from the light emitting section 38, the object on which the light that is emitted from the light emitting section 38 is incident changes from the platen 26 to the print paper P, and thus the size of the electrical signal, that is, the value output by the light-receiving section 40 of the reflective optical sensor 29 that receives the light that is reflected is changed. Then, by measuring the size of this electrical signal with the electrical signal measuring section 66, the fact that the end of the print paper P has passed the light is detected.

When movement of the carriage 28 in step S14 is over, whether or not the print paper P was in the progress direction of the light during movement of the carriage 28 in the main-scanning direction is determined based on the output value of the light-receiving section 40 (step S16). That is, by determining whether or not the end of the print paper P on the upstream side in the paper feed direction (hereinafter, this end may also be referred to as the bottom end) has passed the predetermined position in the paper feed direction (in this embodiment, the position in the paper feed direction of the nozzle #360), the portion of the print paper P located on the upstream side in the paper feed direction is detected.

If the result of the determination of step S16 is that the print paper P was in the progress direction of the light, then after the print paper P is fed in the paper feed direction (step S18), the procedure returns to step S14, and the above-described operations of step S14 through step S18 are repeated until the print paper P is no longer in the progress direction of the light.

If the result of the determination of step S16 is that the print paper P was not in the progress direction of the light, then the following operation is performed.

A more detailed description is provided using FIG. 11A, FIG. 11B, and FIG. 11C. FIG. 11A, FIG. 11B, and FIG. 11C are diagrams that schematically represent the positional relationship between the nozzles of the print head 36 and the print paper P.

In FIGS. 11A to 11C, the small rectangles shown on the left represent the nozzles of the print head 36. The numbers within the rectangles are the nozzle numbers, and correspond to the nozzle numbers shown in FIG. 8. It should be noted that in FIG. 11A to FIG. 11C, for the sake of simplifying the description, only the black nozzle row is shown, and moreover, the first black nozzle row and the second black nozzle row shown in FIG. 8 are shown on the same straight line. In FIGS. 11A to 11C, the circle shown to the right of nozzle #360 represents the reflective optical sensor 29. As described above, the position of the reflective optical sensor 29 in the paper feed direction is identical to the position of the nozzle #360 in the paper feed direction. Also, a portion of the print paper P (lower right end) is shown to the right of the black nozzle row.

First, let us look at FIG. 11A. FIG. 11A represents the positional relationship between the nozzles of the print head 36 and the print paper P when the above-described operations of step S14 through step S18 are repeated and in step S16 it is determined that the print paper P has not arrived in the progress direction of the light. It is clear from the diagram that the print paper P has not arrived in the progress direction of the light that is emitted from the light emitting section 38 of the reflective optical sensor 29 as the carriage 28 provided with the print head 36 and the reflective optical sensor 29 is moved in the main-scanning direction (in this embodiment, the direction of the arrow from left to right in the diagram).

In this manner, if the result of the determination of step S16 is that the print paper P has not arrived in the progress direction of the light, then the print paper P is fed in the paper feed direction as shown in FIG. 11A and FIG. 11B (step S20). In this embodiment, the print paper P is fed by 25·D (D is the dot pitch).

Next, the carriage 28 is moved in the main-scanning direction (in this embodiment, the direction of the arrow from left to right in FIG. 11B) and ink is ejected from the nozzles of the print head 36 provided in the carriage 28 so as to perform borderless printing (step S24). During this printing, however, of the plurality of nozzles of the print head 36, ink is not ejected from the nozzles located on the upstream side in the paper feed direction. In this embodiment, ink is kept from being ejected from the nozzle located most upstream in the paper feed direction and the nozzles within a predetermined distance from that nozzle in the paper feed direction, and in FIG. 11B these nozzles are the nozzles #353 to #360, shown by rectangles drawn with dashed lines.

It can be understood from the above that a procedure (step S22) for determining the nozzles to be kept from ejecting ink is necessary before borderless printing is performed by ejecting ink from the nozzles of the print head 36 (step S24). A specific method for determining which nozzles are kept from ejecting ink is discussed later.

Next, as shown in FIG. 11B and FIG. 11C, the print paper P is further fed in the paper feed direction (step S20). In this embodiment, here also the print paper P is fed by 25·D (D is the dot pitch).

Then, the carriage 28 is moved in the main-scanning direction (in this embodiment, the direction of the arrow, from left to right in FIG. 11C) and ink is ejected from the nozzles of the print head 36 provided in the carriage 28 so as to perform borderless printing (step S24). In this printing as well, of the plurality of nozzles of the print head 36, ink is not ejected from the nozzles positioned on the upstream side in the paper feed direction. In this embodiment, ink is kept from being ejected from the nozzle located most upstream in the paper feed direction and the nozzles within a predetermined distance from that nozzle in the paper feed direction, and in FIG. 11C these nozzles correspond to the nozzles #340 to #360, which are shown by rectangles drawn with dashed lines. The nozzles from which ink is not ejected are determined prior to step S24 (step S22).

After the above procedure, that is, the procedure from step S20 to S24, has been repeated a predetermined number of times (in FIG. 10, N is the number of times), printing of the print paper P is ended (step S26). The print paper P is then discharged by the paper feed motor 31, which is driven by the sub-scanning drive circuit 62 (step S28). It should be noted that since it is necessary to completely fill the print paper P with dots, the predetermined number of times N is determined based on the above-mentioned nozzle pitch k, whether or not a so-called overlap recording method is used, and the number of nozzles for recording dot groups on the same main-scan line if overlap recording is used, for example.

<<<Method for Determining Nozzles Kept from Ejecting Ink>>>

As described above, the nozzles kept from ejecting ink are determined in step S22. Here, an example of the method for determining these nozzles is described using FIG. 10, FIG. 11A, FIG. 11B, and FIG. 11C.

First, as has been mentioned already, in this embodiment the nozzles that do not eject ink are, the nozzle located most upstream in the paper feed direction and the nozzles that are within a predetermined distance in the paper feed direction from that nozzle. That is, in the example of FIGS. 11A to 11C, these are the nozzle #360 and the nozzles within a predetermined distance in the paper feed direction from nozzle #360.

The predetermined distance is described below. The predetermined distance is set large to correspond to the increase in the aggregate paper feed amount of the print paper P after the portion of the print paper P positioned on the upstream side in the paper feed direction is detected. More specifically, the predetermined distance is the amount obtained by subtracting a predetermined amount from the aggregate paper feed amount of the print paper P after the portion of the print paper P positioned on the upstream side in the paper feed direction is detected. The aggregate paper feed amount in the example of FIG. 11B is 25·D (D is the dot pitch), and in the example of FIG. 11C is (25·D+25·D).

The predetermined amount is determined in correspondence with the detection precision with which the portion of the print paper P on the upstream side in the paper feed direction is detected. If the predetermined distance were simply set to the aggregate paper feed amount, then there is no problem if the portion of the print paper P on the upstream side in the paper feed direction can be detected accurately. However, if it cannot be detected accurately, a situation may occur in which nozzles that are kept from ejecting ink are in opposition to the print paper P. The predetermined amount is set so as to avoid this problem and ensure a certain margin. Consequently, the predetermined amount is smaller, the higher the detection precision with which the portion of the print paper P located on the upstream side in the paper feed direction is detected. In the examples of FIGS. 11A to 11C, the predetermined amount is set to an amount of 10·D.

When the above method is employed in the examples of FIG. 11B and FIG. 11C, the nozzles that do not eject ink are as follows.

In the example of FIG. 11B, the aggregate paper feed amount is 25·D and the predetermined amount is 10·D. Consequently, the predetermined distance is 15·D. The nozzles to be found are nozzle #360 and the nozzles that are within the range of the predetermined distance from nozzle #360 in the paper feed direction, and these nozzles are nozzles #353 to #360. It should be noted that the distance in the paper feed direction from nozzle #360 to nozzle #353 is a distance of 14·D.

In the example of FIG. 11C, the aggregate paper feed amount is 50·D and the predetermined amount is 10·D. Consequently, the predetermined distance is 40·D. The nozzles to be found are nozzle #360 and the nozzles that are within the range of the predetermined distance from nozzle #360 in the paper feed direction, and these nozzles are nozzles #340 to #360. It should be noted that the distance in the paper feed direction from nozzle #360 to nozzle #340 is a distance of 40·D.

As described earlier, the procedure from step S20 to step S24 shown in FIG. 10 is repeated a predetermined number of times (in FIG. 10, N is this number of times). Consequently, step S22 is repeated N number of times. The examples of FIG. 11B and FIG. 11C mentioned above in which the nozzles that are kept from ejecting ink are determined are examples in which the nozzles are determined the first and the second time, respectively, when step S22 is performed. The same method can also be used to determine the nozzles in the third time through n-th time that step S22 is performed.

Second Embodiment

Figure 12:
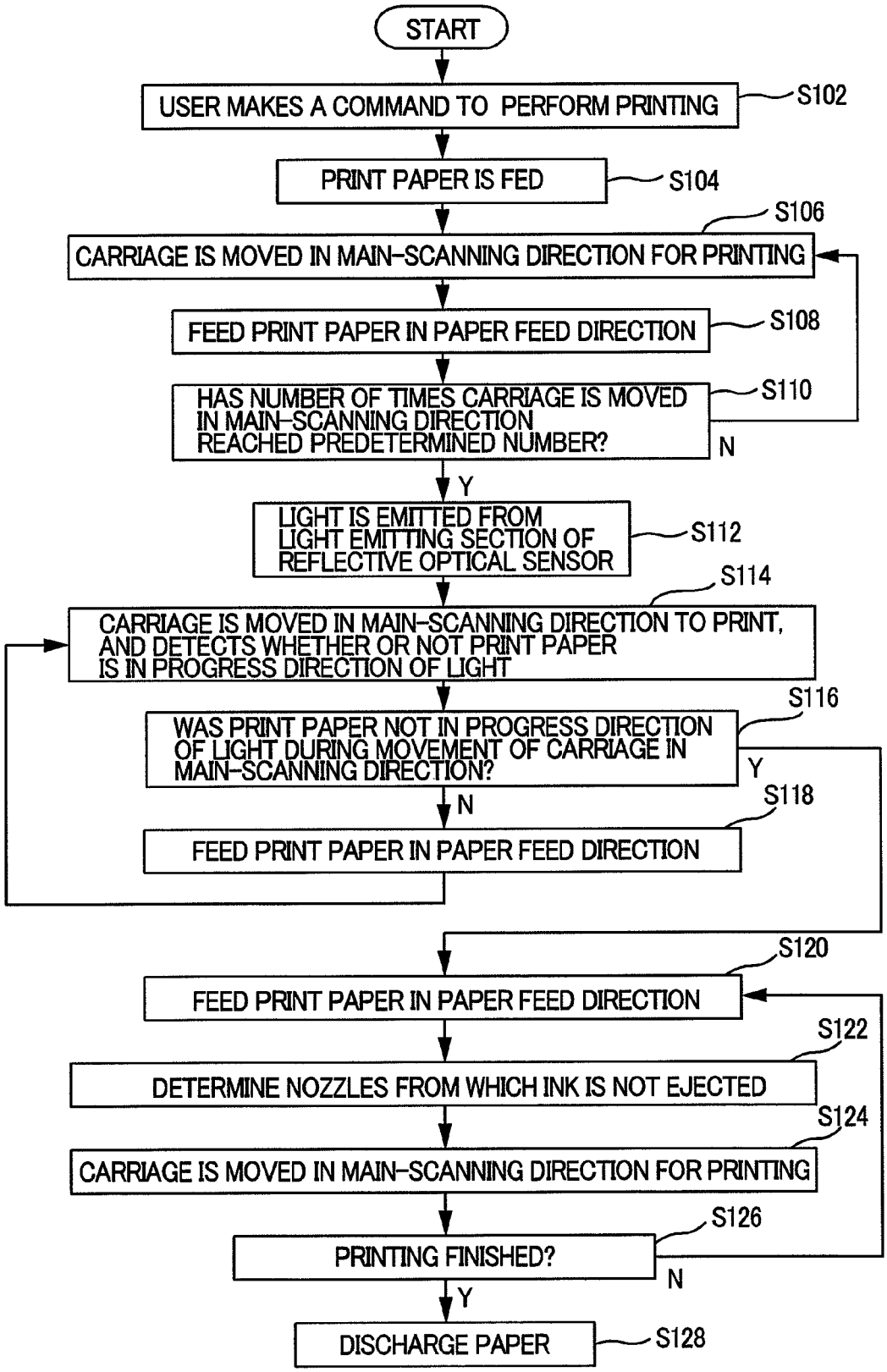
FIG. 12 is a flowchart for describing the second embodiment.
Figures 13A, 13B, 13C:
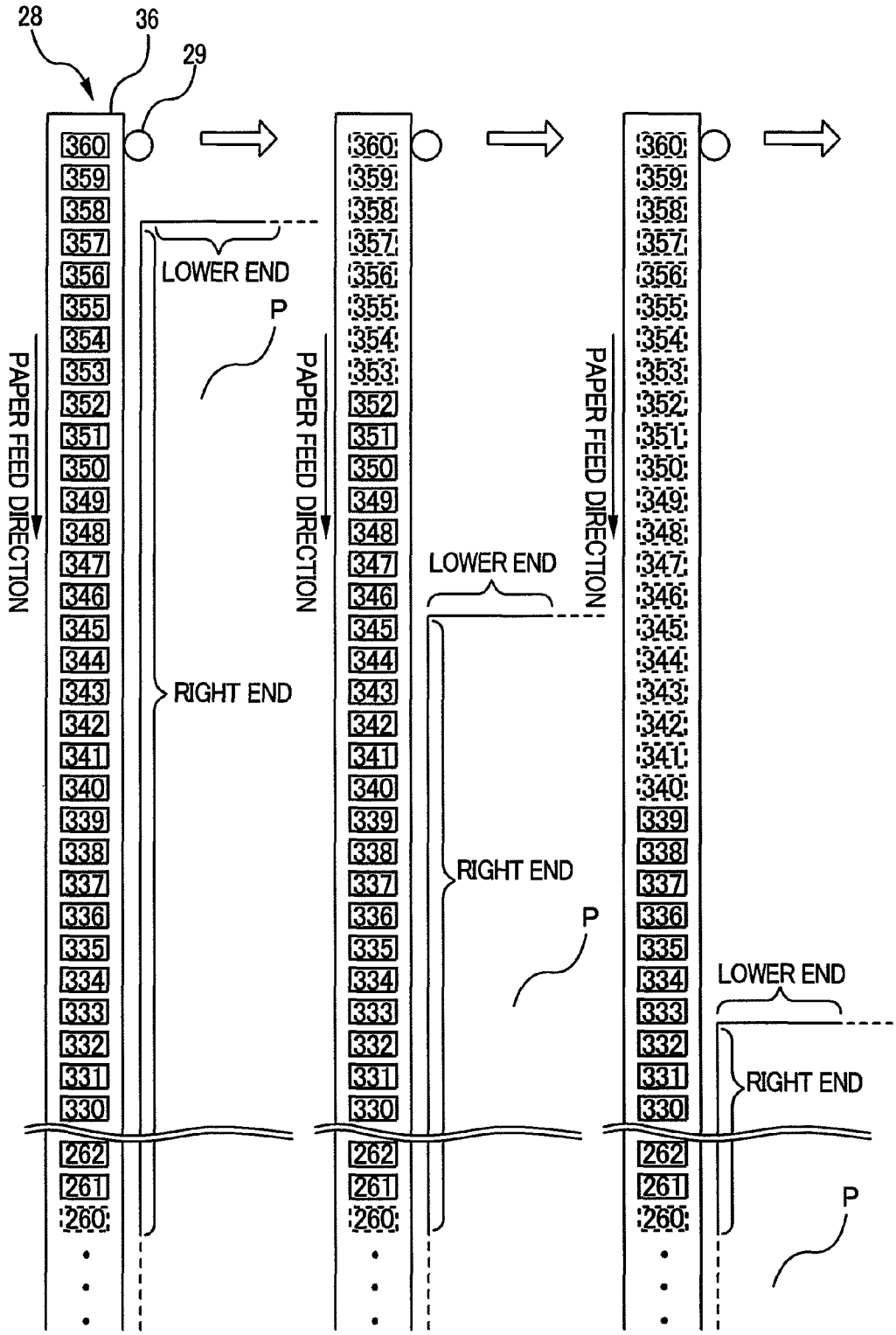
FIG. 13A is diagram that schematically represents the positional relationship between the nozzles of the print head 36 and the print paper P.
FIG. 13B is diagram that schematically represents the positional relationship between the nozzles of the print head 36 and the print paper P.
FIG. 13C is diagram that schematically represents the positional relationship between the nozzles of the print head 36 and the print paper P.

Next, a second embodiment of the present invention is described using FIG. 12, FIG. 13A, FIG. 13B, and FIG. 13C. FIG. 12 is a flowchart for describing the second embodiment. FIG. 13A, FIG. 13B, and FIG. 13C will be described later.

First, the user makes a command to perform printing through the application program 95 or the like (step S102). The application program 95 receives this instruction and issues a print command, at which time the printer driver 96 of the computer 90 receives image data from the application program 95 and converts them to print data PD including raster data indicating the state in which dots are formed during main scanning and data indicating the sub-scanning feed amount. Moreover, the printer driver 96 supplies the print data PD to the color inkjet printer 20 together with various commands COM. The color inkjet printer 20 receives these at its buffer memory 50, after which it sends them to the image buffer 52 or the system controller 54.

The user can also indicate the size of the print paper P or issue a command to perform borderless printing to the user interface display module 101. This instruction by the user is received by the user interface display module 101 and sent to the UI printer interface module 102. The UI printer interface module 102 interprets the instruction that has been issued, and sends a command COM to the color inkjet printer 20. The color inkjet printer 20 receives the command COM at the buffer memory 50, and then transmits it to the system controller 54.

The color inkjet printer 20 then drives, for example, the paper feed motor 31 by the sub-scanning drive circuit 62 based on the command that is sent to the system controller 54 so as to supply the print paper P (step S104).

Then, the system controller 54 moves the carriage 28 in the main-scanning direction while it feeds the print paper P in the paper feed direction, and ejects ink from the print head 36 provided in the carriage 28, carrying out borderless printing (step S106, step S108). It should be noted that the print paper P is fed in the paper feed direction by driving the paper feed motor 31 with the sub-scanning drive circuit 62, the carriage 28 is moved in the main-scanning direction by driving the carriage motor 30 with the main scan drive circuit 61, and ink is ejected from the print head 36 by driving the print head 36 with the head drive circuit 63.

The color inkjet printer 20 carries out the operations of step S106 and step S108 in sequence, and if the number of times the carriage 28 is moved in the main-scanning direction reaches a predetermined number of times (step S110), for example, then, after the carriage 28 is next moved in the main-scanning direction, the following operation is performed.

The system controller 54 controls the reflective optical sensor 29, which is provided in the carriage 28, with the reflective optical sensor control circuit 65, so that light is emitted toward the platen 26 from the light emitting section 38 of the reflective optical sensor 29 (step S112).

The system controller 54 restricts the nozzles that are used to eject ink to predetermined nozzles of the plurality of nozzles, that is, to the nozzles of the upstream side supra-nozzle group Nb, or in other words, to nozzles #261 to #360. That is, in the ink ejection operation from this step on, the system control 54 controls the head drive circuit 63 so that ink is not ejected from nozzles other than those of the upstream side supra-nozzle group Nb.

The system controller 54 moves the carriage 28 in the main-scanning direction and ejects ink from the upstream side supra-nozzle group Nb of the print head 36 provided in the carriage 28 so as to perform borderless printing, as well as emits light from the light emitting section 38 toward a predetermined position in the paper feed direction on the platen 26 but in a plurality of different positions in the main-scanning direction on the platen 26, and based on the output values of the light-receiving section 40 that receives the light that is output, detects whether or not the print paper P is in the progress direction of the light (step S114).

It should be noted that as mentioned above, in this embodiment, the position of the reflective optical sensor 29 in the paper feed direction matches the position of the nozzle #360 in the paper feed direction, and thus the predetermined position in the paper feed direction corresponds to the position of the nozzle #360 in the paper feed direction.

Also, in this embodiment, whether or not the print paper P is in the progress direction of the light is constantly detected while the carriage 28 is moving in the main-scanning direction. That is, when the end of the print paper P blocks the light that is emitted from the light emitting section 38, the object on which the light that is emitted from the light emitting section 38 is incident changes from the platen 26 to the print paper P, and thus the size of the electrical signal, that is, the value output by the light-receiving section 40 of the reflective optical sensor 29 that receives the light that is reflected is changed. Then, by measuring the size of this electrical signal with the electrical signal measuring section 66, the fact that the end of the print paper P has passed through the light is detected.

When movement of the carriage 28 in step S114 is over, whether or not the print paper P was in the progress direction of the light during movement of the carriage 28 in the main-scanning direction is determined based on the output value of the light-receiving section 40 (step S116). That is, it is determined whether or not the end of the print paper P on the upstream side in the paper feed direction passed the predetermined position in the paper feed direction (in this embodiment, the position in the paper feed direction of the nozzle #360).

If the result of the determination of step S116 is that the print paper P has arrived in the progress direction of the light, then after the print paper P is fed in the paper feed direction (step S118), the procedure returns to step S114, and the above-described operations of step S114 through step S118 are repeated until the print paper P is no longer in the progress direction of the light.

If the result of the determination of step S116 is that the print paper P was not in the progress direction of the light, then the following operation is performed.

A more detailed description is provided using FIG. 13A, FIG. 13B, and FIG. 13C. FIG. 13A, FIG. 13B, and FIG. 13C are diagrams that schematically represent the positional relationship between the nozzles of the print head 36 and the print paper P.

In FIGS. 13A to 13C, the small rectangles shown on the left represent the nozzles of the print head 36. The numbers within the rectangles are the nozzle numbers, and correspond to the nozzle numbers shown in FIG. 8. It should be noted that in FIG. 13A to FIG. 13C, for the sake of simplifying the description, only the black nozzle row is shown, and moreover, the first black nozzle row and the second black nozzle row shown in FIG. 8 are represented by the same straight line. In FIGS. 13A to 13C, the circle shown to the right of nozzle #360 represents the reflective optical sensor 29. As mentioned above, the position of the reflective optical sensor 29 in the paper feed direction is identical to the position of the nozzle #360 in the paper feed direction. Also, a portion of the print paper P (lower right end) is shown to the right of the black nozzle row.

First, let us look at FIG. 13A. FIG. 13A represents the positional relationship between the nozzles of the print head 36 and the print paper P when the operations of the above-described step S114 through step S118 are repeated and in step S116 it is determined that the print paper P has not arrived in the progress direction of the light. It is clear from the diagram that the print paper P is not in the progress direction of the light that is emitted from the light emitting section 38 of the reflective optical sensor 29 as the carriage 28 provided with the print head 36 and the reflective optical sensor 29 is moved in the main-scanning direction (in this embodiment, the direction of the arrow from left to right in the diagram).

In this manner, if the result of the determination of step S116 is that the print paper P has not arrived in the progress direction of the light, then the print paper P is fed in the paper feed direction as shown in FIG. 13A and FIG. 13B (step S120). In this embodiment, the print paper P is fed by 25·D (D is the dot pitch).

Next, the carriage 28 is moved in the main-scanning direction (in this embodiment, the direction of the arrow from left to right in FIG. 13B) and ink is ejected from the print head 36 provided in the carriage 28 so as to perform borderless printing (step S124). During this printing, however, of the plurality of nozzles of the print head 36, ink is not ejected from the nozzles located on the upstream side in the paper feed direction. In this embodiment, ink is kept from being ejected from the nozzle located most upstream in the paper feed direction and the nozzles within a predetermined distance from that nozzle in the paper feed direction, and in FIG. 13B these nozzles are nozzles #353 to #360, which are shown by rectangles drawn with dashed lines. It should be noted that as mentioned above, in the ink ejection operation from step S112 and thereafter, the nozzles that are used for ink ejection are restricted to nozzles #261 to #360, and thus when it is detected that the portion of the print paper P on the upstream side in the paper feed direction has passed the predetermined position in the paper feed direction (in this embodiment, the position of the nozzle #360 in the paper feed direction), the ejection of liquid is not carried out from nozzles other than those of the upstream side supra-nozzle group Nb. Consequently, in FIG. 13B, the nozzles that eject ink are the nozzles from #261 to #352.

It can be understood from the above description that a procedure (step S122) for determining the nozzles to be kept from ejecting ink is required before borderless printing is performed by ejecting ink from the nozzles of the print head 36 (step S124). A specific method for determining which nozzles are kept from ejecting ink is discussed later.

Next, as shown in FIG. 13B and FIG. 13C, the print paper P is further fed in the paper feed direction (step S120). In this embodiment, the print paper P is fed by 25·D (D is the dot pitch) here also.

Then, the carriage 28 is moved in the main-scanning direction (in this embodiment, the direction of the arrow from left to right in FIG. 13C) and ink is ejected from the nozzles of the print head 36 provided in the carriage 28 so as to perform borderless printing (step S124). In this printing as well, of the plurality of nozzles of the print head 36, ink is not ejected from the nozzles positioned on the upstream side in the paper feed direction. In this embodiment, ink is kept from being ejected from the nozzle located most upstream in the paper feed direction and the nozzles within a predetermined distance from that nozzle in the paper feed direction, and in FIG. 13C these nozzles correspond to the nozzles #340 to #360, which are shown by rectangles drawn with dashed lines. The nozzles from which ink is not ejected are determined prior to step S124 (step S122). It should be noted that, as discussed earlier, ink is also not ejected from the nozzles #1 to #260 as well.

After the above procedure, that is, the procedure from step S120 to S124, has been repeated a number of times, printing of the print paper P is ended (step S126). The print paper P is then discharged by the paper feed motor 31, which is driven by the sub-scanning drive circuit 62 (step S128). It should be noted that the method for determining the number of times that the procedure of step S120 to step S124 is repeated before printing is finished, that is, the timing at which the ink ejection operation is finished, will be discussed later.

<<<Method for Determining Nozzles Kept from Ejecting Ink>>>

As mentioned above, the nozzles kept from ejecting ink are determined in step S122. Here, an example of the method for determining these nozzles is described with reference to FIG. 12, FIG. 13A, FIG. 13B, and FIG. 13C.

First, as already described above, in this embodiment the nozzles that are kept from ejecting ink are, the nozzle located most upstream in the paper feed direction and the nozzles that are within a predetermined distance in the paper feed direction from that nozzle. That is, in the example of FIGS. 13A to 13C, these are the nozzle #360 and the nozzles within a predetermined distance from nozzle #360 in the paper feed direction.

The predetermined distance is described below. The predetermined distance is set large to correspond to the increase in the aggregate paper feed amount of the print paper P. In this embodiment, the predetermined distance is the amount obtained by subtracting a predetermined amount from the aggregate paper feed amount of the print paper P after the portion of the print paper P on the upstream side in the paper feed direction has passed the predetermined position in the paper feed direction (in this embodiment, the position of the nozzle #360 in the paper feed direction). The aggregate paper feed amount in the example of FIG. 13B is 25·D (D is the dot pitch), and in the example of FIG. 13C is (25·D+25·D).

The predetermined amount is determined in correspondence with the detection precision with which the position in the paper feed direction of the portion of the print paper P on the upstream side in the paper feed direction is detected. If the predetermined distance is simply set to the aggregate paper feed amount, then there is no problem if the position in the paper feed direction of that portion on the upstream side in the paper feed direction can be detected accurately. However, if it cannot be detected accurately, a situation may occur in which nozzles that are kept from ejecting ink are in opposition to the print paper P. The predetermined amount is set so as to avoid this problem and ensure a certain margin. Consequently, the predetermined amount is smaller the higher the detection precision. In the examples of FIGS. 13A to 13C, the predetermined amount is set to an amount of 10·D.

When the above method is employed in the examples of FIG. 13B and FIG. 13C, the nozzles that do not eject ink are as follows.

In the example of FIG. 13B, the aggregate paper feed amount is 25·D and the predetermined amount is 10·D. Consequently, the predetermined distance is 15·D. The nozzles to be found are nozzle #360 and the nozzles that are within the range of the predetermined distance from nozzle #360 in the paper feed direction, and these nozzles are nozzles #353 to #360. It should be noted that the distance in the paper feed direction from nozzle #360 to nozzle #353 is a distance of 14·D.

In the example of FIG. 13C, the aggregate paper feed amount is 50·D and the predetermined amount is 10·D. Consequently, the predetermined distance is 40·D. The nozzles to be found are nozzle #360 and the nozzles that are within the range of the predetermined distance from nozzle #360 in the paper feed direction, and these nozzles are the nozzles from #340 to #360. It should be noted that the distance in the paper feed direction from nozzle #360 to nozzle #340 is a distance of 40·D.

As described earlier, the procedure from step S120 to step S124 shown in FIG. 12 is repeated a number of times. The examples of FIG. 13B and FIG. 13C mentioned above in which the nozzles that are kept from ejecting ink are determined are examples in which the nozzles are determined the first and the second times, respectively, that step S122 is performed. The same method can also be used to determine the nozzles in the third time and thereafter that step S122 is performed.

<<<Method for Determining Timing at which Ink Ejection Operation is Finished>>>

As mentioned above, after the procedure from step S120 to step S124 has been repeated several times, printing of the print paper P is finished (step S126). In this section, the method for determining how many times the procedure from step S120 to step S124 is repeated before printing is finished, or in other words, the timing at which to end the ink ejection operation, is described using FIG. 14. FIG. 14 is an explanatory diagram for describing the method for determining the timing at which to end the ink ejection operation.

As described in earlier sections, the nozzles that are kept from ejecting ink are the nozzle located most upstream in the paper feed direction and the nozzles within a predetermined distance from that nozzle in the paper feed direction, and the predetermined distance increases as the aggregate paper feed amount of the print paper P increases. Consequently, the number of nozzles that are kept from ejecting ink increases in conjunction with an increase in the aggregate paper feed amount of the print paper P.

Then, if the increased number of nozzles that are kept from ejecting ink exceeds the number of nozzles of the upstream side supra-nozzle group Nb, then the operation for ejecting ink to the print paper P is ended.

An example will be provided using FIG. 14. FIG. 14 shows the nozzles that do not eject ink (represented by the letter B in the table) and the number of these nozzles (represented by the letter C in the table) for each time that the procedure from step S120 to step S124 is repeated (represented by the letter A in the table). It also shows the above-mentioned upstream side supra-nozzles (represented by the letter D in the table), the number of those nozzles (represented by the letter E in the table), and the remainder of the number of nozzles C subtracted from the number of nozzles E (represented by the letter F in the table). It should be noted that in this embodiment, the value F obtained by subtracting the number of nozzles C from the number of nozzles E represents the number of nozzles that are allowed to eject ink in that repeat number A of the procedure.

A repeat number A=1 corresponds to the above-described example of FIG. 13B, and the nozzles B are the nozzles #353 to #360. Also, the number of those nozzles C is 8, the upstream side supra-nozzles D are, as described earlier, the nozzles #261 to #360, and the number of those nozzles E is 100. The value of F at this time is 92.

Likewise, a repeat number A=2 corresponds to the above-described example of FIG. 13C, and the nozzles B are the nozzles #340 to #360. Also, the number of those nozzles C is 21, the upstream side supra-nozzles D and the number of those nozzles E remain constant, regardless of the value of the repeat number A, with the upstream side supra-nozzles D being the nozzles #261 to #360 and the number of those nozzles E being 100. The value of F at this time is 79.

In this way, the number of nozzles C that do not eject ink increases in conjunction with an increase in the number of repeats A, whereas the number of upstream side nozzles E is constant, so that the value F decreases as the repeat number A increases.

Then, when the repeat number A reaches a certain number, the value F becomes a negative value. In this embodiment, as shown in FIG. 14, the value F is a positive value (F=4) up to a repeat number of A=8, but the value F becomes a negative value (F=−8) at a repeat number of A=9.

This means that up to A=8 there are nozzles that eject ink (for example, at A=8 ink is ejected from the nozzles #261 to #264), but at A=9 and thereafter there are no longer nozzles that eject ink. Consequently, if the number of nozzles from which ink is not ejected becomes larger than the number of the nozzles of the upstream side supra-nozzle group Nb, that is, if in this embodiment A=9, then ink is no longer ejected toward the print paper P, and the ink ejection operation is ended.

In the above-described first and second embodiments, the portion of the print paper P that is located on the upstream side in the paper feed direction is detected, and based on the results of this detection, ink is not ejected from the nozzles, of the plurality of nozzles, located on the upstream side in the paper feed direction.

As described in the background art section, ink is wasted when ink is ejected from nozzles that are not in opposition to the print paper in a state where some of the nozzle face is not in opposition to the print paper. The condition of ink being ejected from nozzles that are not in opposition to the print paper in the above state is particularly likely to occur in the case of borderless printing, because printing is carried out with respect to the entire surface of the print paper, and this heightens the need to solve the above problem.

Accordingly, by detecting the portion of the print paper that is located on the upstream side in the paper feed direction and, based on the results of that detection, keeping those nozzles of the plurality of nozzles that are located on the upstream side in the paper feed direction from ejecting ink, the amount of ink that is used can be reduced, allowing the above problem to be solved.

It should be noted that a program for carrying out the above processes is stored in the EEPROM 58, and that program is executed by the system controller 54.

Also, in the above description, a reflective optical sensor was used as the optical sensor; however, this is not a limitation. For example, it is also possible to arrange the light emitting section and the light-receiving section in such a manner that they are in opposition and perpendicular to the main-scanning direction and the sub-scanning direction, and also so that they sandwich the print paper.

Also, in the above description, in step S10 and step S110, detection of the fact that the end of the print paper had passed through the light was begun after the carriage 28 had been moved in the main-scanning direction a predetermined number of times. However, this is not a limitation. For example, it is also possible to begin this detection after the first time that the carriage 28 is moved in the main-scanning direction, and likewise it is also possible to find the ideal detection timing by performing calculations, for example, so as to minimize the number of detections.

Also, in the above description, the nozzles from which ink is not ejected were determined in the cycle from step S20 to step S26, or in the cycle from step S120 to step S126, each time the procedure passed step S22 or S122. However, in the first incidence of step S22 or step S122, it is also possible for those nozzles from the first through n-th time of step S22 or step S122 to be determined.

Also, in the above description, in the ink ejection operation of step S112 and thereafter, the nozzles used for ejecting ink were restricted to those of the upstream side supra-nozzle group Nb. However, the start of this restriction is not limited to that particular timing.

Other Embodiments

In the foregoing, an ink ejection control method, for example, according to the invention was described based on an embodiment thereof. However, the foregoing embodiments are for the purpose of elucidating the present invention and are not to be interpreted as limiting the present invention. The invention can of course be altered and improved without departing from the gist thereof and includes functional equivalents.

Print paper was described as an example of the medium, but it also possible to use film, cloth, and thin metal sheets, and the like as the medium.

In the foregoing embodiments, a printing apparatus was described as an example of the liquid ejection apparatus. However, this is not a limitation. For example, technology like that of the embodiments can also be adopted for color filter manufacturing devices, dyeing devices, fine processing devices, semiconductor manufacturing devices, surface processing devices, three-dimensional shape forming machines, liquid vaporizing devices, organic EL manufacturing devices (particularly macromolecular EL manufacturing devices), display manufacturing devices, film formation devices, and DNA chip manufacturing devices. The above-described effects can be maintained even when the present technology is adopted in these fields because of the feature that liquid can be ejected toward a medium.

In the above embodiments, a color inkjet printer was described as an example of the printing apparatus; however, this is not a limitation. For example, the present invention can also be applied to monochrome inkjet printers.

Also, in the above embodiments, ink was used as an example of the liquid; however, this is not a limitation. For example, it is also possible to eject from the nozzles a liquid (including water) including metallic material, organic material (particularly macromolecular material), magnetic material, conductive material, wiring material, film-formation material, processed liquid, and genetic solution.

In the above embodiments, the nozzles positioned on the upstream side in the paper feed direction were the nozzle located most upstream in the paper feed direction and the nozzles within a predetermined distance from that nozzle in the paper feed direction. However, this is not a limitation. For example, the nozzles that eject ink can also be a portion of the nozzle positioned most upstream in the paper feed direction and the nozzles located within a predetermined distance from that nozzle in the paper feed direction.

However, the above embodiments are preferable from the standpoint that they allow the amount of ink that is used to be further reduced.

In the above embodiments, the step of feeding the print paper in the paper feed direction and the step of moving the print head provided with the plurality of nozzles so as to print the print paper were repeated a predetermined number of times after the portion of the print paper located on the upstream side in the paper feed direction was detected, and then printing to the print paper was ended. This is not a limitation, however.

However, the above embodiments are preferable from the standpoint that they allow the print paper to be completely filled with dots.

In the above embodiments, the predetermined number of times was a plural number of times, and the predetermined distance in the step for printing the print paper was increased in correspondence with an increase in the aggregate paper feed amount of the print paper after detection of the portion of the print paper on the upstream side in the paper feed direction. However, this is not a limitation, and it is also possible to set the predetermined distance to a distance that remains constant regardless of the increase in the aggregate paper feed amount, for example.

However, in this case, the above embodiments are preferable from the standpoint that they allow the number of nozzles that do not eject ink to be increased in correspondence with an increase in the number of nozzles that are not in opposition to the print paper, consequently allowing the amount of ink that is consumed to be further reduced.

In the above embodiments, the value obtained by subtracting a predetermined amount from the aggregate paper feed amount served as the predetermined distance. However, there is no limitation to this, and for example, it is also possible to adopt the aggregate paper feed amount as the predetermined distance.

However, the above embodiments are more preferable from the standpoint that they allow a margin to be secured, taking into account the detection error when the portion of the print paper that is located on the upstream side in the paper feed direction is detected.

In the above embodiments, the predetermined amount was made smaller the higher the detection precision with which the portion of the print paper located on the upstream side in the paper feed direction is detected. However, this is not a limitation, and for example, it is also possible to set a value for the predetermined amount that is unrelated to the detection precision.

However, from the standpoint that the nozzles that are kept from ejecting ink can be more effectively determined by adjusting the amount of the margin in accordance with the degree of detection precision, the above embodiments are more preferable.

In the above embodiments, the portion of the print paper that is located on the upstream side in the paper feed direction was detected by determining whether or not the end of the printing paper on the upstream side in the paper feed direction had passed a predetermining position in the paper feed direction. However, this is not a limitation.

However, the above embodiments are preferable from the standpoint that the portion of the print paper that is located on the upstream side in the paper feed direction can be detected more reliably.

In the above embodiments, by determining whether or not the print paper was in the progress direction of the light emitted from the light emitting section, which is for emitting light toward the platen, based on the output value of the light-receiving section for receiving the light that is emitted by the light emitting section, it was determined whether or not the end of the print paper on the upstream side in the paper feed direction had passed a predetermined position in the paper feed direction. However, there is no limitation to this.

However, the above-mentioned embodiments are more preferable from the standpoint that whether or not the end of the print paper that is positioned on the upstream side in the paper feed direction has passed a predetermined position in the paper feed direction can be more easily determined.

In the above embodiments, whether or not the print paper was in the progress direction of the light was determined based on the output value of the light-receiving section for receiving the light that is emitted from the light emitting section toward a predetermined position in the paper feed direction on the platen but toward a plurality of different positions in the main-scanning direction on the platen. However, there is no limitation to this. For example, it is also possible to determine whether or not the print paper is in the progress direction of the light based on the output value of the light-receiving section for receiving the light that is emitted from the light emitting section toward a single position that is in a predetermined position on the platen in the paper feed direction.

However, in this case, the above-mentioned embodiments are preferable from the standpoint that even if the print paper is slanted, for example, it is possible to reliably detect the portion of the print paper that is located on the upstream side in the paper feed direction.

In the above embodiments, whether or not the print paper was in the progress direction of the light while the carriage, which is provided with the light emitting section and the light-receiving section and which can be moved in the main-scanning direction, was moved in the main-scanning direction was determined based on the output value of the light-receiving section for receiving the light that is emitted from the light emitting section toward a predetermined position in the paper feed direction on the platen but toward a plurality of different positions in the main-scanning direction on the platen. However, there is no limitation to this. For example, the positions of the light emitting section and the light-receiving section can be fixed, and whether or not the print paper is in the progress direction of the light can be determined based on the output value of the light-receiving section for receiving the light that is emitted from the light emitting section toward a predetermined position in the paper feed direction on the platen but a plurality of different positions in the main-scanning direction on the platen.

However, in this case, the above embodiments are more preferable from the standpoint that it is not necessary to change the direction in which the light is emitted for each position when light is emitted from the light emitting section toward a plurality of different positions in the main-scanning direction.

In the above embodiments, whether or not the print paper was in the progress direction of the light while the carriage, which is provided with the print head, was moved in the main-scanning direction was detected based on the output value of the light-receiving section for receiving the light that is emitted from the light emitting section toward a predetermined position in the paper feed direction but a plurality of different positions in the main-scanning direction, in addition to printing to the print paper being carried out by ejecting ink from the nozzles provided in the print head. However, there is no limitation to this. For example, it is also possible to adopt a configuration in which the carriage and the light emitting and light-receiving sections are moved in the main-scanning direction individually.

However, in this case, the above embodiments are preferable from the standpoint that the carriage and the light emitting and light-receiving sections can be in a common moving mechanism.

In the above embodiments, borderless printing was performed. This is not a limitation, however.

In the case of borderless printing, however, since printing is carried out with respect to the entire surface of the print paper, a situation where ink is ejected from nozzles that are not in opposition to the print paper when a portion of the nozzle surface is not in opposition to the print paper occurs easily, and thus the above-described methods are even more advantageous.

In the second embodiment, by determining whether or not the portion of the print paper on the upstream side in the paper feed direction has passed a predetermined position in the paper feed direction, the portion of the print paper that is on the upstream side in the paper feed direction is detected, the predetermined distance is increased in conjunction with an increase in the aggregate paper feed amount of the print paper, and the number of nozzles that do not eject ink is increased, and if the number of nozzles that do not eject ink exceeds a predetermined number of nozzles of the plurality of nozzles, then the operation of ejecting ink to the print paper is ended. However, this is not a limitation.

When the portion of the print paper on the upstream side in the paper feed direction has passed the predetermined position in the paper feed direction, the printing operation is nearly over, and it is necessary to determine the timing at which to end the liquid ejection operation. This timing conceivably can be determined based on factors such as the nozzle pitch of the print head, whether or not a so-called overlap recording method is being employed, and if an overlap recording method is employed, the number of nozzles for recording dot groups on the same main scan line. However, if these methods are used to determine the timing, then, for example, effort is required to prepare a database of these factors for each model of color inkjet printer or for each setting of the color inkjet printer, making determination of the timing complicated.

Accordingly, as mentioned above, if the operation of ejecting ink to the print paper is ended when the number of nozzles that are kept from ejecting ink exceeds the number of nozzles of the upstream side supra-nozzle group, then the timing at which the ink ejection operation is ended can be easily determined without having to prepare a database such as that discussed above for each model of color inkjet printer, for example. For this reason, the above embodiments are more preferable.

In the second embodiment, liquid is not ejected from nozzles other than the predetermined nozzles of the plurality of nozzles when it is determined that the portion of the print paper on the upstream side in the paper feed direction has passed the predetermined position in the paper feed direction. However, this is not a limitation, and for example it is also possible to eject liquid from nozzles other than the predetermined nozzles of the plurality of nozzles.

However, the above embodiments are more preferable from the standpoint that the ink ejection operation can be ended in a state where there are no longer nozzles from which ink can be ejected.

Also, in the second embodiment, the predetermined nozzles were in opposition to the recessed sections of the platen, which is provided with recessed sections and which is for supporting the print paper. However, this is not a limitation.

However, the above embodiments are more preferable from the standpoint that if the predetermined nozzles of the plurality of nozzles constitute the upstream side supra-nozzle group, which is in opposition to the recessed sections of the platen, then there is the advantage that, for example, the platen does not become dirty and that later the rear surface of the print paper that is carried is kept from becoming dirty.

In the second embodiment, the predetermined distance was set to the amount obtained by subtracting a predetermined amount from the aggregate paper feed amount; however, this is not a limitation. For example, the aggregate paper feed amount may be set to the predetermined distance.

However, in this case, the above embodiments are more preferable because a margin can be ensured, taking into consideration the detection error when detecting the position in the paper feed direction of the portion of the print paper on the upstream side in the paper feed direction.

In the second embodiment, the predetermined amount was made smaller the higher the detection precision with which the position in the paper feed direction of the portion of the print paper on the upstream side in the paper feed direction is detected. However, this is not a limitation, and for example, it is also possible to set a value for the predetermined amount that is unrelated to the detection precision.

However, the above embodiments are more preferable from the standpoint that by adjusting the amount of margin according to the degree of detection precision, it is possible to more effectively determine the nozzles that are kept from ejecting ink.

What is claimed is:

1. A liquid ejection apparatus comprising:

a feed mechanism that feeds a medium along a predetermined feed direction;

a medium support section that supports the medium;

an ejection head provided with a plurality of nozzles arranged along the feed direction;

a light-emitting member that emits light toward the medium support section;

a light-receiving sensor that receives the light emitted by the light emitting member;

a moving member that is provided with the ejection head and the light-receiving sensor and that is movable in a main-scanning direction; and a controller that controls ejection of liquid from the nozzles and that detects whether or not the medium is present based on an output value of the light-receiving sensor, wherein the controller causes the nozzles to eject the liquid toward the medium and detects whether or not the medium is present while the moving member is moving in the main-scanning direction, and wherein, in a case where a portion of the medium that is positioned on an upstream side in the feed direction has arrived at a downstream side in the feed direction of a nozzle that is located most upstream in the feed direction and the medium is no longer detected, the controller causes nozzles that are located on the upstream side among nozzles not opposing the medium not to eject the liquid and causes nozzles that are located on the downstream side among the nozzles not opposing the medium to eject the liquid after having fed the medium from the upstream side to the downstream side for a predetermined amount, wherein the medium support section has a protruding section that is formed along the main-scanning direction, and a groove that is formed along the main-scanning direction, wherein the nozzles are divided into nozzle groups including a first nozzle group and a second nozzle group different from the first nozzle group, wherein the first nozzle group keeps opposing the protruding section and does not oppose the groove while the moving member is moving over a full width of the medium along the main-scanning direction, and wherein the second nozzle group does not oppose the protruding section and keeps opposing the groove while the moving member is moving over the full width of the medium along the main-scanning direction.

2. A liquid ejection apparatus according to claim 1, wherein the liquid is ejected to an entire surface of the medium.

3. A liquid ejection apparatus according to claim 1, wherein the liquid is ink, and wherein the liquid ejection apparatus is a printing apparatus that prints on print paper that corresponds to the medium by ejecting ink from the nozzles.

4. A liquid ejection method using a liquid ejection apparatus, comprising:

A) preparing the liquid ejection apparatus having, a feed mechanism that feeds a medium along a predetermined feed direction, a medium support section that supports the medium, an ejection head provided with a plurality of nozzles arranged along the feed direction, a light-emitting member that emits light toward the medium support section, a light-receiving sensor that receives the light emitted by the light emitting member, a moving member that is provided with the ejection head and the light-receiving sensor and that is movable in a main-scanning direction, and a controller that controls ejection of liquid from the nozzles and that detects whether or not the medium is present based on an output value of the light-receiving sensor, wherein the medium support section has a protruding section that is formed along the main-scanning direction, and a groove that is formed along the main-scanning direction; and B) causing the controller to perform a process including, causing the nozzles to eject the liquid toward the medium and detecting whether or not the medium is present while the moving member is moving in the main-scanning direction, and in a case where a portion of the medium that is positioned on an upstream side in the feed direction has arrived at a downstream side in the feed direction of a nozzle that is located most upstream in the feed direction and the medium is no longer detected, causing nozzles that are located on the upstream side among nozzles not opposing the medium not to eject the liquid and causing nozzles that are located on the downstream side among the nozzles not opposing the medium to eject the liquid after having fed the medium from the upstream side to the downstream side for a predetermined amount, wherein the nozzles are divided into nozzle groups including a first nozzle group and a second nozzle group different from the first nozzle group, wherein the first nozzle group keeps opposing the protruding section and does not oppose the groove while the moving member is moving over a full width of the medium along the main-scanning direction, and wherein the second nozzle group does not oppose the protruding section and keeps opposing the groove while the moving member is moving over the full width of the medium along the main-scanning direction.

5. A liquid ejection method according to claim 4, wherein the liquid is ejected to an entire surface of the medium.

6. A liquid ejection method according to claim 4, wherein the liquid is ink, and wherein the liquid ejection apparatus is a printing apparatus that prints on print paper that corresponds to the medium by ejecting ink from the nozzles.

* * * * *